US007556906B2

(12) United States Patent
Katoh et al.

(10) Patent No.: US 7,556,906 B2
(45) Date of Patent: Jul. 7, 2009

(54) TONER, AND IMAGE FORMING METHOD, IMAGE FORMING APPARATUS, AND PROCESS CARTRIDGE USING THE TONER

(75) Inventors: Hiroaki Katoh, Nagaokakyo (JP); Masayuki Hagi, Minoo (JP); Takuya Kadota, Kobe (JP); Yoshihiro Mikuriya, Nishinomiya (JP); Katsunori Kurose, Takarazuka (JP); Atsushi Yamamoto, Kawanishi (JP); Masahide Inoue, Katsuragi (JP); Minoru Nakamura, Takarazuka (JP); Chiyoshi Nozaki, Otsu (JP); Tsuyoshi Nozaki, Ikeda (JP); Hideaki Yasunaga, Ibaraki (JP)

(73) Assignee: Ricoh Company Limited, Tokyo (JP)

( * ) Notice: Subject to any disclaimer, the term of this patent is extended or adjusted under 35 U.S.C. 154(b) by 288 days.

(21) Appl. No.: 11/563,697

(22) Filed: Nov. 28, 2006

(65) Prior Publication Data

US 2007/0122729 A1 May 31, 2007

(30) Foreign Application Priority Data

Nov. 30, 2005 (JP) ..... 2005-344838
Nov. 30, 2005 (JP) ..... 2005-346392

(51) Int. Cl.
*G03G 9/08* (2006.01)

(52) U.S. Cl. ..... 430/108.8; 430/109.4; 430/124.1; 430/137.14; 399/159

(58) Field of Classification Search ..... 430/108.8, 430/108.1, 109.4, 137.14, 137.2, 124.1
See application file for complete search history.

(56) References Cited

U.S. PATENT DOCUMENTS 6,363,229 B1 * 3/2002 Shiraishi et al. ..... 399/68
2003/0108808 A1 * 6/2003 Inoue et al. ..... 430/108.8
2007/0122729 A1 5/2007 Katoh et al.
2008/0199234 A1 8/2008 Hagi et al.

FOREIGN PATENT DOCUMENTS

JP 06-324525 11/1994
JP 10-073950 3/1998

(Continued)

OTHER PUBLICATIONS

U.S. Appl. No. 11/924,994, filed Oct. 26, 2007, Katoh, et al.

(Continued)

*Primary Examiner*—John L Goodrow
(74) *Attorney, Agent, or Firm*—Oblon, Spivak, McClelland, Maier & Neustadt, P.C.

(57) ABSTRACT

A toner is provided including a colorant; a resin composition (A) comprising at least one binder resin and a hydrocarbon wax having a melting point of 70-90° C. in an amount of from 6 to 30% by weight based on total weight of resin composition (A), and having a softening point ($T_{1/2}$(A)) of from 120 to 150° C.; and a resin composition (B) having a softening point ($T_{1/2}$ (B)) of from 100 to 130° C., wherein a weight ratio of the resin composition (A) to the resin composition (B) is from 10/90 to 45/55, and the following relationship is satisfied: $T_{1/2}(A) \geqq T_{1/2}(B)+3$; and the use of the toner in an image forming method, an image forming apparatus, and a process cartridge.

19 Claims, 5 Drawing Sheets

FOREIGN PATENT DOCUMENTS

| | | |
|---|---|---|
| JP | 11-084711 | 3/1999 |
| JP | 2000-227675 | 8/2000 |
| JP | 2001-117261 | 4/2001 |
| JP | 2001-125414 | 5/2001 |
| JP | 2002-148844 | 5/2002 |
| JP | 2003-043729 | 2/2003 |
| JP | 2003-255587 | 9/2003 |
| JP | 2003-270859 | 9/2003 |
| JP | 2004-046095 | 2/2004 |
| JP | 2004-126268 | 4/2004 |
| JP | 2004-133095 | 4/2004 |
| JP | 2004-184561 | 7/2004 |
| JP | 2004-206081 | 7/2004 |
| JP | 2004-325955 | 11/2004 |

OTHER PUBLICATIONS

U.S. Appl. No. 11/857,175, filed Sep. 18, 2007, Matsumoto, et al.
U.S. Appl. No. 11/963,279, filed Dec. 21, 2007, Mikuriya, et al.
U.S. Appl. No. 11/965,522, filed Dec. 27, 2007, Fuwa et al.
U.S. Appl. No. 12/051,248, filed Mar. 19, 2008, Hagi et al.
U.S. Appl. No. 12/010,369, filed Jan. 24, 2008, Yasunaga, et al.
U.S. Appl. No. 12/027,704, filed Feb. 7, 2008, Fuwa, et al.
U.S. Appl. No. 12/048,865, filed Mar. 14, 2008, Yasunaga, et al.
U.S. Appl. No. 11/851,048, filed Sep. 6, 2007, Murakami, et al.
U.S. Appl. No. 11/851,617, filed Sep. 7, 2007, Murakami, et al.
U.S. Appl. No. 11/854,783, filed Sep. 13, 2007, Nakamura, et al.
U.S. Appl. No. 11/855,759, filed Sep. 14, 2007, Katoh, et al.
U.S. Appl. No. 11/856,248, filed Sep. 17, 2007, Murakami, et al.
U.S. Appl. No. 11/855,739, filed Sep. 14, 2007, Fuwa, et al.
U.S. Appl. No. 12/241,656, filed Sep. 30, 2008, Yasunaga, et al.

* cited by examiner

TONER, AND IMAGE FORMING METHOD, IMAGE FORMING APPARATUS, AND PROCESS CARTRIDGE USING THE TONER

BACKGROUND OF THE INVENTION

1. Field of the Invention

The present invention relates to a toner for use in electrophotography. In addition, the present invention also relates to an image forming method, an image forming apparatus, and a process cartridge using the toner.

2. Discussion of the Background

As electrophotographic technology is developed, image forming apparatuses using electrophotography such as laser printers, copiers, and multi function peripherals (i.e., MFP) are widely used in offices.

Recently, demands for low-price, easy-maintenance, and compact apparatus, which does not give an oppressive feeling even if being set beside a desk, have increased. In addition, demands for image forming apparatus which easily produces appealing color images have increased.

A typical image forming apparatus using electrophotography uses a toner including at least a binder resin and a colorant, and an image is typically formed as follows:

(1) An image bearing member (e.g., a photoreceptor drum, a photoreceptor belt) is evenly charged with a charging means (e.g., a charging roller, a charging brush) (i.e., charging process);

(2) The image bearing member is irradiated with a light source (e.g., a laser, a light-emitting diode) so as to form an electrostatic latent image thereon (i.e., irradiating process);

(3) A toner bearing member (e.g., a developing roller, a developing sleeve) approaches or contacts the image bearing member so as to develop the electrostatic latent image with a toner to form a toner image (i.e., developing process);

(4) The toner image formed on the image bearing member is optionally transferred onto a transfer member (e.g., an intermediate transfer roller, an intermediate transfer belt) (i.e., transfer process);

(5) The toner image formed on the image bearing member or the transfer member is transferred onto a recording member (e.g., a paper, an overhead projection (OHP) sheet) (i.e., transfer process); and (6) The toner image formed on the recording member is melted upon application of pressure and heat from a fixing thereon (e.g., a fixing roller, a fixing belt) so as to be fixed thereon.

In particular, a full-color image can be formed as follows.

(1) The above charging, irradiating, developing, and transfer processes are repeatedly performed using a least 2 toner bearing members, each of which includes a different-color toner, to form a full-color toner image on the transfer member or the recording member, and then the full-color toner image is subjected to the succeeding processes (i.e., four-cycle method).

(2) The above charging, irradiating, developing processes are simultaneously performed using at least 2 sets of an image bearing member and a toner bearing member, each of which includes a different-color toner, to form a single-color toner image on each of the image bearing members. Plural single-color toner images are transferred onto the transfer member or the recording member to form a full-color toner image thereon, and then the full-color toner image is subjected to the succeeding processes (i.e., tandem method).

Dry developing methods used for electrophotography or electrostatic recording are classified into two-component developing methods using a two-component developer consisting of a toner and a carrier, and one-component developing methods using a one-component developer consisting of a toner.

In general, the two-component developing methods can stably produce high quality images. However, the carrier tends to deteriorate and the mixing ratio between the toner and the carrier tends to vary with long-term use, and therefore high quality images cannot be produced or a long period of time. There are other drawbacks that the image forming apparatus using the two-component developing method is not easy to perform maintenance, and is difficult to be smaller in size.

Therefore, one-component developing methods, which have no drawback mentioned above, receive attention recently.

In a typical one-component developing method, at least one toner transport member transports a toner (i.e., a one-component developer) to visualize an electrostatic latent image formed on an image bearing member. It is considered that a toner layer formed on the toner transport member should be as thin as possible.

This is because the one-component developer (i.e., a toner having high electric resistance) needs to be charged by a developing device. When the toner layer is too thick, only toner particles present at the surface of the toner layer are charged, i.e. all of the toner particles cannot be evenly charged.

For the above reason, various methods for controlling toner layer thickness have been proposed.

For example, a control blade is proposed. The control blade is arranged facing the toner transport member, and presses the toner layer to the toner transport member to control the toner layer thickness.

A control roller can also be used instead of the control blade.

In attempting to satisfy the demands for low-price, easy-maintenance, and compact apparatus, oilless fixing processes, in which no fixing oil is used or less amount of fixing oil is used in a fixing process, have been proposed.

When a toner is melted in a typical fixing process, the toner tends to adhere to a fixing member, and therefore the fixing member cannot separate from the recording member having the toner thereon. As a result, the recording member cannot be discharged from the apparatus, resulting in occurrence of a paper jam. In attempting to prevent the occurrence of the paper jam, the following technique is proposed in which an oil applicator for applying an oil such as a silicone oil to the fixing member is arranged so as to separate the recording member therefrom. However, this technique has a drawback that the oil applicator takes up a large space in the apparatus, and therefore the apparatus becomes larger in size. Another drawback is that users using the apparatus have the trouble of supplying new oil when the oil is consumed. En a tempting to solve the problems of the oil applicator, a technique in which a wax is added to a toner is proposed. When such a toner is used in a fixing process, the wax exudes from the toner to the interface between the toner and the fixing member, and decrease adherence therebetween. As a result, the fixing member and the recording member can well separate from each other (this property hereinafter referred to as separativeness). A fixing process using a toner including a wax is called an oilless fixing process.

In order to impart good separativeness to a toner, a wax is preferably dispersed toner Generally speaking, waxes have low polarity, and therefore waxes are incompatible with toner binder resins which typically have functional groups Therefore, the wax particles tend to expose at the surface of the toner particles or release therefrom, when the toner is manufactured. The wax particles released from the toner particles tend to contaminate image forming members and deteriorate fluidity of the toner. When such a toner is used for a one-component developing method, in which a toner present on a toner bearing member is evenly charged while forming an even toner layer by rotating itself under a pressure applied by a toner layer control member (e.g., a control blade), the wax and fluidizers tend to firmly stick to the toner layer forming member. As a result, the toner layer is distributed, and therefore the quality of the resultant toner image largely deteriorates.

In attempting to solve the above problems, various techniques have been proposed.

For example, a technique in which the amount of a wax added to a toner is decreased and the elasticity of a binder resin is increased is proposed. In this case, the toner is hardly melted, and therefore fixability of the toner, and glossiness and image quality of the resultant images deteriorate.

In attempting to solve this problem without deteriorating developability and separativeness of the resultant toner, a technique in which a resin internally containing a wax is used as a binder resin of a toner is proposed.

For example, published unexamined Japanese Patent Application No. (hereinafter referred to as JP-A) 2001-117261 discloses a toner including a specific wax. Since wax has too high a melting point, the wax takes a long time to melt at low temperatures, and therefore the wax insufficiently exudes from the toner. Such a toner has insufficient separativeness. JP-A-2002-148844 discloses a toner having a high thermal property, and JP-A 2003-270859 discloses a toner including a large amount of a resin having high melt-viscosity. These toners produce low-glossiness images having poor image quality and poor fixing strength. JP-A 2003-255587 discloses a toner including a resin internally containing a wax. Since the resin internally containing a wax has a low softening point, the wax tends to expose at the surface of the toner and exert a bad influence on the image forming processes.

JP-A 06-324525 discloses an image forming method using a toner in which a large amount of an external additive is added thereto to improve transferability thereof. When the amount of the external additive is too large, the external additive inhibits fusing of the toner particles when the toner is fixed upon application of heat. In addition, excessive released external additive particles cause offset problem and deterioration of the fixing strength.

As mentioned above, a toner containing a wax has various drawbacks when used for a non-magnetic one-component developing method in which the toner is contact-charged by a contact control member such as a doctor blade and a doctor roller.

When such a wax-containing toner is used for a non-magnetic one-component developing method, the wax is required to exude from the toner in the fixing process so that the toner has good separativeness. On the other hand, the wax is not required to firmly adhere to the contact control member in the charging process. However, these two requirements are difficult to satisfy at the same time.

In order to satisfy both of the requirements at the same time, the wax is preferably added to a binder resin when the binder resin is synthesized. In other words, the wax is preferably mixed with monomers of the binder resin before the monomers are subjected to a polymerization. (This method is hereinafter referred to as internal addition method.)

In this case, the wax is incompatible with the binder resin, and it is easier to control the condition of the wax domains present in the binder resin compared with the case where a wax is mixed with a synthesized resin.

When a wax is added to a binder resin when the binder resin is synthesized, a wax having a functional group in a molecular chain thereof such as a carnauba wax having an ester bond formed from a higher alcohol and a higher fatty acid and an amide wax having an amide bond are not preferably used. This is because there is a possibility that such a wax reacts with the monomers of the binder resin. In this case, the wax cannot exert its effect and cannot impart good separativeness to the resultant toner.

For this reason, a hydrocarbon wax having no functional group is preferably used for the internal addition method.

The hydrocarbon wax can impart good separativeness to the resultant toner. However, the polarity thereof is largely different from that of the binder resin (compared with a wax having a functional group), and therefore the wax and the binder resin are incompatible and not sufficiently mixed with each other. In other words, the wax domains are present in the binder resin and form a sea-island structure.

In this case, the toner is required to have good mixing balance between the wax and the resin so that the toner properties are highly balanced.

SUMMARY OF THE INVENTION

Accordingly, an object of the present invention is to provide a toner having good fixability (such as separativeness between a fixing member and adhesiveness between a recording material), used for the oilless fixing process.

Another object of the present invention is to provide an image forming method which can produce high quality images.

Further object of the present invention is to provide an image forming apparatus a process cartridge in which the toner does not adhere to image forming members such as a photoreceptor and a control blade.

These and other objects of the present invention, either individually or in combinations thereof as hereinafter will become more readily apparent can be attained by a toner, comprising:

a colorant;

resin composition (A) comprising at least one binder resin and a hydrocarbon wax having a melting point of 70-90° C. in an amount of from 6 to 30% by weight based on total weight of resin composition (A), and having a softening point ($T_{1/2}$(A)) of from 120 to 150° C.; and a resin composition (B) having a softening point ($T_{1/2}$ (B)) of from 100 to 130° C., wherein a weight ratio ((A)/(B)) of the resin composition (A) to the resin composition (B) is from 10/90 to 45/55, and wherein the following relationship is satisfied:

$$T_{1/2}(A) \geqq T_{1/2}(B)+3;$$

and an image forming method, an image forming apparatus, and a process cartridge using the above toner.

BRIEF DESCRIPTION OF THE DRAWINGS

These and other objects, features and advantages of the present invention will become apparent upon consideration of the following description of the preferred embodiments of the present invention taken in conjunct-on with the accompanying drawings, wherein.

DETAILED DESCRIPTION OF THE INVENTION

Figure 1:
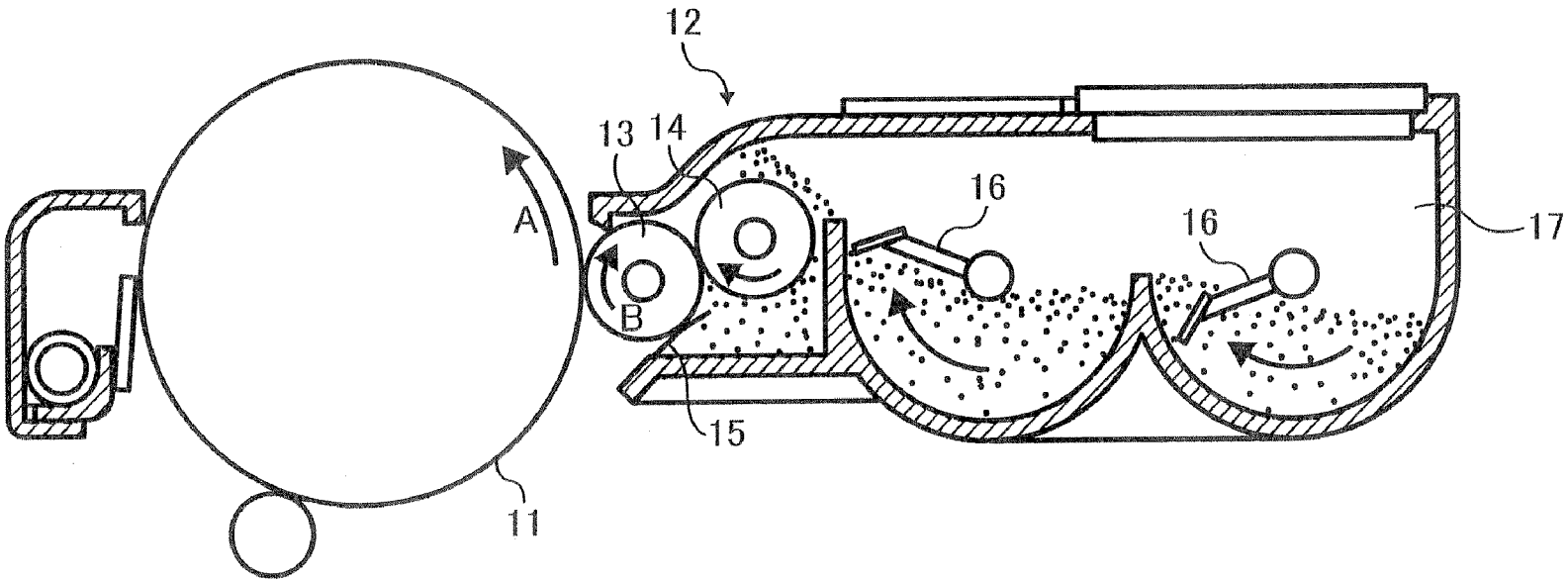
FIG. 1 is a schematic view or explaining the image forming method of the present invention.

Generally, the present invention provides a toner, comprising:

a colorant;

a first resin composition (A) comprising at least one binder resin and a wax, and having a softening point of $T_{1/2}$(A); and a second resin composition (B) comprising at least one binder resin and no wax, and having a softening point of $T_{1/2}$(B), wherein the first resin composition (A) and the second resin composition (B) are mixed at a specific ratio, and wherein the $T_{1/2}$(A) and the $T_{1/2}$(B) has a specific relationship.

The toner constituent of the present invention will be explained in detail.

Binder Resin

Any known toner binder resins can be used for the resin compositions (A) and (B) of the present invention, and are not particularly limited specific examples such resins include, but are not limited to, polyester resins, polyurethane resins, polyurea resins, epoxy resins, vinyl resins, copolymers thereof, (meth) acrylic resins, styrene-(meth)acrylic copolymer resins, COC (i.e., cyclic olefin copolymers such as TOPAS® COC manufactured by Ticona), etc. Among these, polyester resins, vinyl resins, and block copolymers and graft copolymers thereof are preferably used, and polyester resins are most preferably used in terms of improving oilless fixing property of the resultant toner.

Polyester Resin

As the polyester resin, polyester resins formed from a polycondensation reaction between a polyol (1) and a polycarboxylic acid (2) can be used.

As the polyol (1), diols (1-1), polyols (1-2) having three or more valences, and mixtures thereof can be used, and a diol (1-1) alone or mixtures in which a did (1-1) is mixed with a small amount of a polyol (1-2) having three or more valences are preferably used.

Specific examples of the diols (1-1) include, but are not limited to, alkylene glycols (e.g., ethylene glycol, 1,2-propylene glycol, 1,3-propylene glycol, 1,4-butanediol, 1,6-hexanediol), alkylene ether glycols (e.g., diethylene glycol, triethylene glycol, dipropylene glycol, polyethylene glycol, polypropylene glycol, polytetramethylene ether glycol), alicyclicdiols (e.g., 1,4-cyclohexanedimethanol, hydrogenated bisphenol A), bisphenols (e.g., bisphenol A, bisphenol F, bisphenol S), adducts of the alicyclic diols with an alkylene oxide (e.g., ethylene oxide, propylene oxide, butylenes oxide), adducts of the bisphenols with an alkylene oxide (e.g., ethylene oxide, propylene oxide, butylenes oxide), etc.

Among these, alkylene glycols having 2 to 12 carbon atoms and adducts of bisphenols with an alkylene oxide are prefer ably used, and a mixture thereof is more preferably used.

Specific examples of the polyols (1-2) having three or more valences include, but are not limited to, multivalent aliphatic alcohols having three or more valences (e.g., glycerin, trimethylolethane, trimethylolpropane, pentaerythritol, sorbitol), polyphenols having three or more valences (e.g., trisphenol PA, phenol novolac, cresol novolac), adducts of the polyphenols having three or more valences with an alkylene oxide, etc.

As the polycarboxylic acid (2), dicarboxylic acids (2-1) and polycarboxylic acids (2-2) having three or more valences, and mixtures thereof can be used, and a dicarboxylic acid (2-1) alone or mixtures in which a dicarboxylic acid (2-1) is mixed with a small amount of a polycarboxylic acid (2-2) having three or more valences are preferably used.

Specific examples of the dicarboxylic acids (2-1) include, but are not limited to, alkylene dicarboxylic acids (e.g., succinic acid, adipic acid, sebacic acid), alkenylene dicarboxylic acids (e.g., maleic acid, fumaric acid), aromatic dicarboxylic acids (e.g., phthalic acid, isophthalic acid, terephthalic acid, naphthalene dicarboxylic acid), etc.

Among these, alkenylene dicarboxylic acids having 4 to 20 carbon atoms and aromatic dicarboxylic acids having 8 to 20 carbon atoms are preferably used.

Specific examples of the polycarboxylic acids (2-2) having three or more valences-include, but are not limited to, aromatic polycarboxylic acids having 9 to 20 carbon atoms (e.g., trimellitic, pyromellitic acid), etc.

As the polycarboxylic acid (2), acid anhydrides and lower alkyl esters of the above dicarboxylic acids (2-1) and polycarboxylic acids (2-2) having three or more valences can also be used.

As the polyester resin, polyester resins formed from a polycondensation reaction between a polyol (3) and a polycarboxylic acid (4) can also be used.

As the polyol (3), diols (3-1) and polyols (3-2) having three or more valences can be used.

Specific examples of the diols (3-1) include, but are not limited to, alkylene oxide adducts of bisphenol A (e.g., polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane, polyoxyethylene(2,0)-2,2-bis(4-hydroxyphenyl)propane)), ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polytetramethylene glycol, bisphenol A, hydrogenated bisphenol A, etc.

Specific examples of the polyols (3-2) having three or more valences include, but are not limited to, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, etc.

As the polycarboxylic acid (4), dicarboxylic acids (4-1) and polycarboxylic acids (4-2) having three or more valences can be used.

Specific examples of the dicarboxylic acids (4-1) include, but are not limited to, maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenylsuccinic acid, isododecylsuccinic acid, n-dodecylsuccinic acid, isododecylsuccinic acid, n-octenylsuccinic acid, isooctenylsuccinic acid, n-octylsuccinic acid, isooctylsuccinic acid, anhydrides and lower alkyl esters of these acids, etc.

Specific examples of the polycarboxylic acids (4-2) having three or more valences include, but are not limited to, 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, anhydrides and lower alkyl esters of these acids, etc.

Vinyl Resin

The vinyl resin used for the present invention is homopolymer or a copolymer of a vinyl monomer. Specific preferred examples of si-table vinyl monomers are shown as follows (1) Vinyl hydrocarbons:

aliphatic vinyl hydrocarbons such as alkenes (e.g., ethylene, propylene, butene, isobutylene, pentene, heptene, diisobutylene, octene, dodecene, octadecene, other α-olefins except the above-mentioned compounds) and alkadienes (e.g., butadiene, isoprene, 1,4-pentadiene, 1,6-hexadiene, 1,7-octadiene);

alicyclic vinyl hydrocarbons such as monocycloalkenes, dicycloalkenes, and alkadienes (e.g., cyclohexene, (di)cyclopentadiene, vinylcyclohexene, ethylidenebicycloheptene); and terpenes (e.g., pinene, limonene, indene); and aromatic vinyl hydrocarbons such as styrene and hydrocarbonic (alkyl, cycloalkyl, aralkyl and/or alkenyl) derivatives thereof (e.g., α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, trivinylbenzene), and vinylnaphthalene;

(2) Vinyl monomers including carboxyl group and salts thereof:

unsaturated monocarboxylic or dicarboxylic acids having 3 to 30 carbon atoms and anhydrides and monoalkyl (1 to 24 carbon atoms) esters thereof (e.g., (meth)acrylic acid, maleic acid, maleic anhydride, monoalkyl maleate, fumaric acid, monoalkyl fumarate, crotonic acid, itaconic acid, monoalkyl itaconate, itaconic glycol monoether, citraconic acid, monoalkyl citraconate, cinnamic acid);

(3) Vinyl monomers including sulfonic group and vinyl monoesters of sulfuric acid, and salts thereof:

alkene sulfonic acids having 2 to 14 carbon atoms (e.g., vinyl sulfonic acid, (meth) allyl sulfonic acid, methyl vinyl sulfonic acid, styrene sulfonic acid), and alkyl derivatives thereof having 2 to 24 carbon atoms (e.g., α-methylstyrene sulfonic acid); sulfo(hydroxy)alkyl(meth)acrylates or (meth)acrylamides (e.g., sulfopropyl(meth)acrylate, 2-hydroxy-3-(meth)acryloxypropyl sulfonic acid, 2-(meth) acryloylamino-2,2-dimethylethane sulfonic acid, 2-(meth) acryloyloxyethane sulfonic acid, 3-(meth)acryloyloxy-2-hydroxypropane sulfonic acid, 2-(meth)acrylamide-2-methylpropane sulfonic acid, 3-(meth)acrylamide-2-hydroxypropane sulfonic acid, alkyl (3 to 18 carbon atoms) allylsulfo succinic acid, succinic acid ester of poly(n is 2 to 30)oxyalkylene (ethylene, propylene, butylene and mono, random and block copolymers thereof) mono(meth)acrylate such as sulfuric acid ester of poly(n is 5 to 15)oxypropylene monomethacrylate, sulfuric acid esters of polyoxyethylene polycyclic phenylether); and salts thereof;

(4) Vinyl monomers including phosphate group and salts thereof:

(meth)acryloyloxyalkyl phosphoric acid monoesters (e.g., 2-hydroxyethyl(meth) acryloyl phosphate, phenyl-2-acryloyloxyethyl phosphate); (meth)acryloyloxyalkyl(1 to 24 carbon atoms) phosphonic acids (e.g., 2-acryloyloxyethyl phosphonic acid); and salts thereof.

Specific examples of the above-mentioned salts of monomers shown in the above paragraphs (2) to (4) include alkali metal salts (e.g., sodium salts, potassium salts), alkaline-earth metal salts (e.g., calcium salts, magnesium salts), ammonium salts, amine salts and quaternary ammonium salts.

(5) Vinyl monomers including hydroxyl group:

hydroxystyrene, N-methylol(meth)acrylamide, hydroxyethyl (meth)acrylate, hydroxypropyl(meth)acrylate, polyethyleneglycol mono(meth)acrylate, (meth)allylalcohol, crotyl alcohol, isocrotyl alcohol, 1-butene-3-ol, 2-butene-1-ol, 2-butene-1,4-diol, propargyl alcohol, 2-hydroxyethyl propenyl ether, and sucrose allyl ether;

(6) Vinyl monomers including nitrogen:

vinyl monomers including amino group (e.g., aminoethyl (meth)acrylate, dimethylaminoethyl(meth)acrylate, diethylaminoethyl(meth)acrylate, t-butylaminoethyl (meth) acrylate, N-aminoethyl(meth)acrylamide, (meth) acrylamine, morpholinoethyl(meth)acrylate, 4-vinylpyridine, 2-vinylpyridine, crotylamine, N,N-dimethylaminostyrene, methyl-α-acetoamino acrylate, vinylimidazole, N-vinylpyrrol, N-vinylthiopyrrolidone, N-arylphenylenediamine, aminocarbazole, aminothiazole, aminoindole, aminopyrrol, aminoimidazole, aminomercaptothiazole, and salts thereof);

vinyl monomers including amide group (e.g., (meth)acrylamide, N-methyl(meth)acrylamide, N-butylacrylamide, diacetoneacrylamide, N-methylol(meth)acrylamide, N,N-methylene-bis(meth)acrylamide, cinammic acid amide, N,N-dimethylacrylamide, N,N-dibenzylacrylamide, methacrylformamide, N-methyl-N-vinylacetamide, N-vinylpyrrolidone);

vinyl monomers including nitrile group (e.g., (meth)acrylonitrile, cyanostyrene, cyanoacrylate);

vinyl monomers including quaternary ammonium cation group such as quaternary compounds of vinyl monomers (e.g., dimethylaminoethyl(meth)acrylate, diethylaminoethyl(meth)acrylate, dimethylaminoethyl(meth)acrylamide, diethylaminoethyl(meth)acrylamide, diallylamine) including tertiary amine group produced by using quaternate agent (e.g., methyl chloride, dimethyl sulfonic acid, benzyl chloride, dimethyl carbonate); and vinyl monomers including nitro group (e.g., Nitrostyrene);

(7) Vinyl monomers including epoxy group:

Glycidyl(meth)acrylate, tetrahydrofurfuryl(meth)acrylate, p-vinylphenylphenyloxide;

(8) Vinyl monomers including halogen group:

vinyl chloride, vinyl bromide, vinylidene chloride, allyl chloride, chlorostyrene, bromostyrene, dichlorostyrene, chloromethylstyrene, tetrafluorostyrene, and chloroprene;

(9) Vinylesters, vinyl(thio)ethers, vinylketones, vinylsulfones:

vinylesters (e.g., vinyl acetate, vinyl butyrate, vinyl propionate, diallyl phthalate, diallyl adipate, isopropenyl acetate, vinyl methacrylate, methyl-4-vinyl benzoate, cyclohexyl methacrylate, benzyl methacrylate, phenyl (meth)acrylate, vinylmethoxy acetate, vinyl benzoate, ethyl-α-ethoxy acrylate, alkyl(meth)acrylates including alkyl group having 1 to 50 carbon atoms (such as methyl (meth)acrylate, ethyl(meth)acrylate, propyl(meth)acrylate, butyl(meth)acrylate, 2-ethylhexyl(meth)acrylate, dodecyl(meth)acrylate, hexadecyl(meth)acrylate, heptadecyl(meth)acrylate, and eicocyl(meth)acrylate), dialkyl fumarates (2 alkyl groups have 2 to 8 carbon atoms and have straight-chain, branched-chain or alicyclic structure), dialkyl maleates (2 alkyl groups have 2 to 8 carbon atoms and have straight-chain, branched-chain or alicyclic structure), poly(meth)allyloxyalkanes (such as diallyloxyethane, triallyloxyethane, tetraallyloxyethane, tetraallyloxypropane, tetraallyloxybutane, and tetramethallyloxyethane), vinyl monomers including polyalkyleneglycol chain (such as polyethyleneglycol (molecular weight of 300) mono(meth)acrylate, polypropyleneglycol (molecular weight of 500) monoacrylate, adduct of methy alcohol(meth)acrylate with 10 mols of ethyleneoxide, and adduct of lauryl alcohol (meth) acrylate with 30 mols of ethyleneoxide), and poly(meth)acrylates ((meth)acrylates of polyalcohols such as ethyleneglycol di(meth)acrylate, propyleneglycol di(meth)acrylate, neopentylglycol di(meth)acrylate, trimethylolpropane tri (meth)acrylate, and polyethyleneglycol di(meth)acrylate));

vinyl(thio)ethers (e.g., vinylmethylether, vinylethylether, vinylpropylether, vinylbutylether, vinyl-2-ethylhexylether, vinylphenylether, vinyl-2-methoxyethylether, methoxybutadiene, vinyl-2-butoxyethylether, 3,4-dihydro-1,2-pyran, 2-butoxy-2'-vinyloxydiethylether, vinyl-2-ethylmercaptoethylether, acetoxystyrene, phenoxystyrene);

vinylketones (e.g., vinyl methyl ketone, vinyl ethyl ketone, vinyl phenyl ketone); and vinylsulfones (e.g., divinylsulfide, p-vinyldiphenylsulfide, vinylethylsulfide, vinylethylsulufone, divinylsulfone, divinylsulfoxide);

(10) Another vinyl monomers:

isocyanatoethyl(meth)acrylate, and m-isopropenyl-α,α-dimethylbenzylisocyanate.

Specific examples of the copolymers of vinyl monomers include copolymers of two or more vinyl monomers shown in the above paragraphs (1) to (10) at any mixing ratio such as styrene-(meth)acrylate copolymer, styrene-butadiene copolymer, (meth)acrylic acid-acrylate copolymer, styrene-acrylonitrile copolymer, styrene-maleic anhydride copolymer, styrene-(meth)acrylic acid copolymer, styrene-(meth) acrylic acid-divinylbenzene copolymer, and styrene-styrene sulfonic acid-(meth)acrylate copolymer.

Combined Resin

In addition, block copolymers and graft copolymers formed by linking (i) a polyester resin and a vinyl resin, (ii) plural kinds of polyester resins, and (iii) plural kinds of vinyl resins can be used. Such block copolymers and graft copolymers can be obtained by any known methods as follows:

(1) Polymerizing a vinyl monomer in the presence of a polyester resin having a vinyl group, an allyl group, or a (meth)acryloyl group.

(2) Polymerizing a polyol and a polycarboxylic acid in the presence of a vinyl resin having a hydroxyl group, a carboxylic acid group, or an amino group.

(3) Subjecting a vinyl monomer, a polyol, a polycarboxylic acid, and a vinyl monomer having at least one functional group selected from carboxyl group, hydroxyl group, amino group, and epoxy group, to an addition-polymerization and condensation-polymerization, simultaneously.

In other words, a resin obtained by simultaneously subjecting a mixture of (i) raw material monomers of a polyester resin, (ii) raw material monomers of a vinyl resin, and (iii) a monomer capable of the raw material monomers, to both a condensation polymerization reaction (for preparing polyester resin) and a radical polymerization reaction (for preparing vinyl resin), in a reaction vessel, can be used. Such a resin is hereinafter referred to as a vinyl polyester resin.

The above monomer capable of reacting with the both raw material monomers is, in other words, a monomer capable of condensation-polymerizing and radical-polymerizing. That is, a monomer including a carboxyl group capable of condensation-polymerizing and a vinyl group capable of radical-polymerizing. Specific examples of such monomers include, but are not limited to, fumaric acid, maleic acid, acrylic acid, methacrylic acid, etc.

Specific examples of the raw material monomers of a polyester resin include, but are not limited to, the above-mentioned polyols and polycarboxylic acids.

Specific examples of the raw material monomers of a vinyl resin include, but are not limited to, the above-mentioned vinyl monomers and monomers such as styrene derivatives (e.g., styrene, o-methylstyrene, m-methylstyrene, p-methylstyrene, α-methylstyrene, p-ethylstyrene, 2,4-dimethylstyrene, p-tert-butylstyrene, p-chlorostyrene), ethylene-based unsaturated monoolefins (e.g., ethylene, propylene, butylene, isobutylene), alkyl esters of methacrylic acids (e.g., methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-methylbutyl methacrylate, hexyl methacrylate, octyl methacrylate, nonyl methacrylate, decyl methacrylate, undecyl methacrylate, dodecyl methacrylate), alkyl esters of acrylic acids (e.g., methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-methylbutyl acrylate, hexyl acrylate, octyl acrylate, nonyl acrylate, decyl acrylate, undecyl acrylate, dodecyl acrylate), unsaturated carboxylic acids (e.g., acrylic acid, methacrylic acid, itaconic acid, maleic acid), acrylonitriles, maleates, itaconates, vinyl chlorides, vinyl acetates, vinyl benzoates, methyl vinyl ketones, ethyl vinyl ketones, hexyl vinyl ketones, methyl vinyl ethers, ethyl vinyl ethers, isobutyl vinyl ethers, etc.

Specific examples of radical polymerization initiators for use in the radical polymerization includes, but are not limited to, azo or diazo initiators (e.g., 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile), peroxide initiators (e.g., benzoylperoxide, methyl ethyl ketone peroxide, isopropyl peroxycarbonate, lauroyl peroxide), etc.

In terms of improving separativeness and hot offset resistance of the resultant toner, the first resin composition (A) preferably includes a polyester resin formed from a polycondensation reaction between a polyol and a polycarboxylic acid. In particular, a polyester resin formed from a polycondensation reaction between an alkylene oxide adduct of bisphenol A (i.e., polyol), and terephthalic acid and fumaric acid (i.e., polycarboxylic acids) is preferably used.

The second resin composition (B) preferably includes a vinyl polyester resin. In particular, a vinyl polyester resin formed from polyester raw material monomers such as an alkylene oxide adduct of bisphenol A, terephthalic acid, trimelitic acid, and succinic acid; vinyl raw material monomers such as styrene and butyl acrylate; and raw material monomers capable of condensation-polymerizing and radical-polymerizing such as fumaric acid is preferably used.

Resin Composition (A) Containing Hydrocarbon Wax

The resin composition (A) used for the toner of the present invention includes at least one binder resin and a hydrocarbon wax. The resin composition (A) is preferably prepared by reacting raw material monomers of the binder resin in the presence of the hydrocarbon wax.

For example, when the resin composition (A) includes a polyester resin, an acid monomer and an alcohol monomer are subjected to a condensation polymerization reaction in the presence of the hydrocarbon wax.

When the resin composition (A) includes a vinyl polyester resin, raw material monomers of a polyester resin are agitated and heated in the presence of the hydrocarbon wax, and raw material monomers of a vinyl resin are added thereto, and then the mixture is simultaneously subjected to a condensation polymerization reaction and a radical polymerization reaction.

The resin composition (A) can be prepared by the following methods.

(1) Polymerizing monomers (e.g., a polyol, a polycarboxylic acid, a vinyl monomer) in which a wax is dissolved or dispersed therein. Optionally subjecting the resultant polymers to a preparation of a block copolymer or a graft copolymer.

(2) Dissolving a wax and a resin in a solvent to finely disperse the wax in the resin, and then removing the solvent therefrom.

(3) Melt-kneading a wax and a resin.

The resin preferably has a cross-linking structure because the wax can be evenly dispersed and sufficiently incorporated therein.

The resin composition (A) contains the hydrocarbon wax in an amount of from 6 to 30% by weight, preferably from 8 to 27% by weight, and more preferably from 9 to 25% by weight based on total weight of resin composition (A). When the amount of the wax is too small, the ratio of the wax to the binder resin is too small, and therefore the wax cannot sufficiently exude from the twisted structures of the high-molecular-weight polymer (i.e., the binder resin) and cannot exert separativeness thereof. In contrast, when the amount of the wax is too large, the wax cannot be sufficiently incorporated into the binder resin. As a result, a large amount of the wax tends to expose at the surface of the toner, and contaminates image forming members such as a developing member and a photoreceptor.

The resin composition (A) has a softening point $T_{1/2}$(A) of from 120 to 150° C., and preferably from 120 to 140° C. In the present invention, the softening point is defined as a ½ method temperature ($T_{1/2}$) determined using a constant-pressure extrusion capillary rheometer. When the $T_{1/2}$(A) is too small, the wax cannot be sufficiently incorporated into the toner, and tends to expose at the surface of the toner. When the $T_{1/2}$(A) is too large, the toner cannot be easily melted, and therefore fixability of the toner deteriorates.

Resin Composition (B) Containing No Wax

As the resin composition (B) containing no wax, any known toner binder resins can be used, and are not particularly limited. Specific examples of the binder resins include, but are not limited to, polyester resins, polyurethane resins, polyurea resins, epoxy resins, vinyl resins, and copolymers thereof. Among these, polyester resins, vinyl resins, and block copolymers and graft copolymers thereof are preferably used.

The resin composition (B) has a softening point $T_{1/2}$(B) of from 100 to 130° C., and preferably from 105 to 120° C. In particular, $T_{1/2}$(B) is 3° C. smaller, preferably 5° C. smaller, and more preferably 7° C. smaller than $T_{1/2}$(A).

Since the resin composition (A) is designed to have relatively high viscosity so that the wax is completely incorporated into the toner, the resin composition (B) is design to have a viscosity lower than that of the resin composition (A) so as to improve fixing strength of the toner.

When the $T_{1/2}$(B) is too small, toner particles tend to be fused with each other under high temperature and high humidity conditions, i.e., preservation stability of the toner deteriorates When the $T_{1/2}$(B) is too large, the toner cannot be easily melted, and therefore fixability of the toner deteriorates.

Acid Value

The toner of the present invention has an acid value of from 10 to 40 mgKOH/g. When the acid value is too small, fixing strength of the toner deteriorates. When the acid value is too large, environmental resistance of the toner deteriorates.

Each of the resin composition (A) and the resin composition (B), independently, has an acid value of from 5 to 50 KOHmg/g, and preferably from 10 to 40 mgKOH/g.

In particular, polyester resins having the above acid value can improve colorant dispersibility in the resultant toner and impart good chargeability thereto.

THF Insoluble Components

The resin composition (A) preferably includes tetrahydrofuran (THF) insoluble components in an amount of from 0.1 to 15% by weight, more preferably from 0.2 to 10% by weight, and much more preferably from 0.3 to 5% by weight, in terms of improving hot offset resistance of the resultant toner.

Mixing Ratio Between Resin Compositions (A) and (B)

The weight ratio (i.e., (A)/(B)) of the resin composition (A) (including a hydrocarbon wax) to the resin composition (B) is from 10/80 to 45/55, preferably from 20/80 to 45/55, and more preferably from 30/70 to 40/60.

When the amount of the resin composition (A) is too small, separativeness and hot offset resistance of the resultant toner deteriorates. When the amount of the resin composition (A) is too large, glossiness of the produced Image and thermostable preservability of the resultant toner deteriorate.

A mixture of the resin composition (A) and the resin composition (B), which satisfies the above weight ratio, has a softening point ($T_{1/2}$) of from 100 to 125° C., and preferably from 105 to 125° C.

Wax

Next, the wax for use in the present invention will be explained in detail.

Generally speaking, a wax having low polarity is easily separated (released) from a fixing roller. In the present invention, a hydrocarbon wax having low polarity is used.

The hydrocarbon wax is a wax consisting essentially of carbon atoms and hydrogen atoms, and includes no functional group such as ester group, alcohol group, and amide group.

Specific examples of the hydrocarbon waxes include, but are not limited to, polyolefin waxes (e.g., polyethylene waxes, polypropylene waxes, ethylene-propylene copolymers), petroleum waxes (e.g., paraffin waxes, microcrystalline waxes), synthesized waxes (e.g., Fisher-Tropsch waxes), etc. Among these, polyethylene waxes, paraffin waxes, and Fisher-Tropsch waxes are preferably used, polyethylene waxes and paraffin waxes are more preferably used, and paraffin waxes are most preferably used.

The wax for use in the present invention has a melting point of from 70 to 90° C. The melting point is determined by finding a temperature at which an endothermic peak is observed in a temperature rising scan of a differential scanning calorimeter (DSC).

When the melting point is too high, the wax cannot be sufficiently melted when the toner is fixed, and therefore the toner cannot sufficiently separate from the fixing member. When the meting point is too low, toner particles tend to be fused with each other under high temperature and high humidity conditions, i.e., preservation stability of the toner deteriorates. In order to impart good separativeness to the toner at low temperatures, the wax preferably has a melting point of from 70 to 85° C., and more preferably from 70 to 80° C.

The endothermic peak, which is observed in a temperature rising scan of a DSC, preferably has a half bandwidth of not larger than 7° C. Since the wax has a relatively low melting point, when the half bandwidth is too large, the wax starts melting at a low temperature, and therefore thermostable preservability of the toner deteriorates.

The toner of the present invention includes a hydrocarbon wax in an amount of from 3 to 10% by weight, preferably from 4 to 8% by weight, and more preferably from 4 to 6.5% by weight. When the amount of the wax is too small, the sufficient amount of the wax cannot exude from the toner and cannot decrease the adherence between the toner and the fixing member. Therefore, the recording member having the toner thereon is hardly separated from the fixing member. In contrast, when the amount of the wax is too large, a large amount of the wax tends to expose at the surface of the toner, and therefore fluidity of the toner deteriorates. As a result, transfer efficiency (from developing unit to photoreceptor, and from photoreceptor to recording member) of the toner decreases, and therefore the resultant image quality largely deteriorates. In addition, the wax present at the surface of the toner tends to release therefrom and contaminate image forming members such as a developing member and a photoreceptor.

The toner of the present invention may further include a hydrocarbon wax which is not present in the resin composition (A) so long as the toner does not deteriorate the toner property.

Colorant

Specific examples of the colorants for use in the toner of the present invention include any known dyes and pigments such as carbon black, Nigrosine dyes, black iron oxide, NAPHTHOL YELLOW S, HANSA YELLOW (10G, 5G and G) Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (C and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B. Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials can be used alone or in combination.

The following colorants can also be used; carbon black, aniline blue, chalco oil blue, chrome yellow, Ultramarine Blue, Oil Red, Quinoline Yellow, Methylene Blue Chloride, copper phthalocyanine, Malachite Green Oxalate, Lamp Black, Rose Bengal, C. I. Pigment Red 48:1, C. I. Pigment Red 122, C. I. Pigment Red 57:1, C. I. Pigment Red 184, C. I. Pigment Yellow 97, C. I. Pigment Yellow 12, C. I. Pigment Yellow 17, C. I. Solvent Yellow 162, C. I. Pigment Yellow 180, C. I. Pigment Yellow 185, C. I. Pigment Blue 15:1, C. I. Pigment Blue 15:3, etc.

The toner preferably includes a colorant in an amount of from 1 to 15% by weight, and more preferably from 3 to 10% by weight.

The colorant for use in the present invention is preferably combined with a resin to be used as a master batch. Is more preferable that the colorant is dispersed in the mixture of the resin compositions (A) and (B), in terms of improving dispersability of the colorant. Specific examples of the resin for use in the master batch include, but are not limited to, polyester resins, vinyl resins, rosins, modified rosins, terpene resins, aliphatic or alicyclic hydrocarbon resins, aromatic petroleum resins, chlorinated paraffins, paraffin waxes, etc. These resins can be used alone or in combination.

A master batch is added to the toner so that the toner includes the colorant in an amount of the above range.

The master batch preferably includes a colorant in an amount of from 20 to 40% by weight.

Charge Controlling Agent

The toner of the present invention may optionally include a charge controlling agent. Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts Of salicylic acid, and salicylic acid derivatives, but are not limited thereto.

Specific examples of commercially available charge controlling agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product) which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenylmethane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent is determined depending on the species of the binder resin used, regardless of addition of an additive and toner manufacturing method (such as dispersion method) used, and is not particularly limited. However, the content of the charge controlling agent is typically from 0.1 to 10% by weight, and preferably from 0.2 to 5% by weight, based on the binder resin included in the toner. When the content is too high, the toner has too large a charge quantity, and thereby the electrostatic force of a developing roller attracting the toner increases, resulting in deterioration of the fluidity of the toner and image density of the toner images. The charge controlling agent can be melt-kneaded with a master batch or a binder resin, or directly dissolved in an organic solvent, or fixed on the surface of the toner.

Wax Dispersing Agent

The toner of the present invention may optionally include a wax dispersing agent.

Any known wax dispersing agents can be used, and are not particularly limited. Specific examples of the wax dispersing agents include, but are not limited to, polymers and oligomers including a unit compatible with a wax and a unit compatible with a resin; polymers and oligomers in which one of a unit compatible with a wax and a unit compatible with a resin is grafted to the other unit; copolymers of (i) unsaturated hydrocarbons (e.g., ethylene, propylene, butene, styrene, α-styrene) with (ii) α,β-unsaturated carboxylic acids or esters or anhydrides thereof (e.g., acrylic acid, methacrylic acid, maleic acid, maleic anhydride, itaconic acid, itaconic anhydride); block or graft copolymers of vinyl resins with polyester resins; etc.

Specific examples of the units compatible with a wax include, but are not limited to, long-chain alkyl groups having 12 or more carbon atoms; polyethylene, polypropylene, polybutene, polybutadiene, and copolymers thereof; etc.

Specific examples of the units compatible with a resin include, but are not limited to, polyester resin, vinyl resin, etc.

The amount of the wax dispersing agent is from 0.1 to 5 times that of the wax, and preferably from 0.3 to 2.5 times that of the wax. When the amount of the wax dispersing agent is too small, the wax cannot be sufficiently dispersed. When the amount of the wax dispersing agent is too large, the sufficient amount of the wax cannot exude from the toner, and therefore the toner has poor separativeness.

External Additive

Toner particles are preferably mixed with an external additive to improve fluidity, developability, and chargeability of the toner. Particulate inorganic materials are typically used as the external additive. Particulate inorganic materials having a primary particle diameter of from 2 nm to 2 μm, and preferably from 5 nm to 500 nm, are preferably used. The specific surface area of the particulate inorganic material is preferably from 20 to 500 $m^2/g$ when measured by a BET method. The content of the particulate inorganic material is preferably from 0.01 to 5.0% by weight, and more preferably from 0.01 to 2.0% by weight, based on the total weight of the toner.

It is more preferable that toner particles are mixed with two kinds of external additives. In this case, the first particulate inorganic material has a BET specific surface area of from 100 to 300 $m^2/g$, and the second particulate inorganic material has a BET specific surface area of from 40 to 100 $m^2/g$.

Specific examples of such particulate inorganic materials include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

The toner preferably includes an external additive in an amount of from 2.5 to 5.0 parts by weight. When the amount is too large, developability and separativeness of the resultant toner deteriorate and foggy images are produced. When the amount is too small, fluidity, transferability, and thermostable preservability of the resultant toner deteriorate.

Toner Manufacturing Method

The toner of the present invention can be prepared by any known-toner manufacturing methods such as pulverization methods, emulsion polymerization aggregation methods, and suspension polymerization methods.

In an emulsion polymerization aggregation-method, a wax is dissolved or dispersed in a vinyl monomer, and then the vinyl monomer is subjected to a polymerization (such as miniemulsion polymerization) to prepare a vinyl resin composition in which the wax is internally dispersed in the resultant vinyl resin. A dispersion of the vinyl resin composition and a colorant dispersion are mixed so that the dispersing elements are aggregated and fused to prepare a toner slurry. The toner slurry is washed, filtered, and dried by any known methods, to obtain a toner.

A pulverization method includes the following steps:

mechanically mixing toner constituents, comprising a resin composition containing a wax, a resin composition containing no wax, and a colorant, to prepare a toner constituent mixture (i.e., mixing process);

melt-kneading the toner constituent mixture to prepare a kneaded mixture (i.e., melt-kneading process);

pulverizing the kneaded mixture to prepare a pulverized mixture (i.e., pulverization process); and classifying the pulverized mixture to prepare a toner (i.e., classification process).

When undesired particles are produced in the pulverization and the classification processes, these particles can be recycled in the mixing and melt-kneading process.

In the mixing process, any known mixers having rotating blade can be used under any known conditions, and the mixers are not particularly limited.

In the melt-kneading process, the toner constituent mixture is melt-kneaded using a kneader. Specific examples of the kneaders include, but are not limited to, single-axis or double-axis continuous kneaders and batch kneaders using a roll mill. Specific examples of commercially available kneaders include, but are not limited to, TWIN SCREW EXTRUDER KTK from Kobe Steel, Ltd., TWIN SCREW COMPOUNDER TEM from Toshiba Machine Co., Ltd., MIRACLE K.C.K from Asada Iron Works Co., Ltd., TWIN SCREW EXTRUDER PCM from Ikegai Co., Ltd., KOKNEADER from Buss Corporation, etc. The melt-kneading process should be performed such that the molecular chain of the binder resin is not cut. In particular, the melt-kneading temperature should be determined considering the softening point of the binder resin When the melt-kneading temperature is too lower than the softening point of the binder resin, the molecular chain is cut. When the melt-kneading temperature is too higher than the softening point of the binder resin, toner constituents cannot be well dispersed.

In the pulverization process, the kneaded mixture is pulverized. The kneaded mixture is preferably subjected to coarse pulverization at first, followed by fine pulverization. Suitable pulverization methods include a method in which the particles collide with a collision board in a jet stream; a method in which the particles collide with each other in a jet mill; and the particles are pulverized in a narrow gap formed between a mechanically rotating rotor and a stator; etc. The pulverized particles are classified in an air using centrifugal force, to prepare a toner having a desired particle diameter.

The toner preferably has a volume average particle diameter of from 4 to 10 μm, and more preferably from 5 to 10 μm.

Image Forming Method and Image Forming Apparatus

FIG. 1 is a schematic view for explaining the image forming method of the present invention.

A photoreceptor 11 rotates in the direction indicated by an arrow A. A developing roller 13 included in a developing device 12 rotates in the direction indicated by an arrow B, while contacting the photoreceptor 11 or forming a gap of from 0.1 to 0.3 mm therebetween.

The developing roller 13 is made of a metallic conductive material such as aluminum and stainless, the surface of which is sandblast-treated so that the surface has an appropriate roughness. Around the developing roller 13, a toner supplying roller 14 and a control blade (toner layer thickness control blade) 15 formed of a blade spring to which a rubber plate (e.g., an urethane rubber, a silicone rubber) is attached or a metal such as SUS are arranged.

A toner feeding shaft 16 configured to feed a toner to the toner supplying roller 14 is rotatably arranged in a toner containing room 17.

Figure 2:
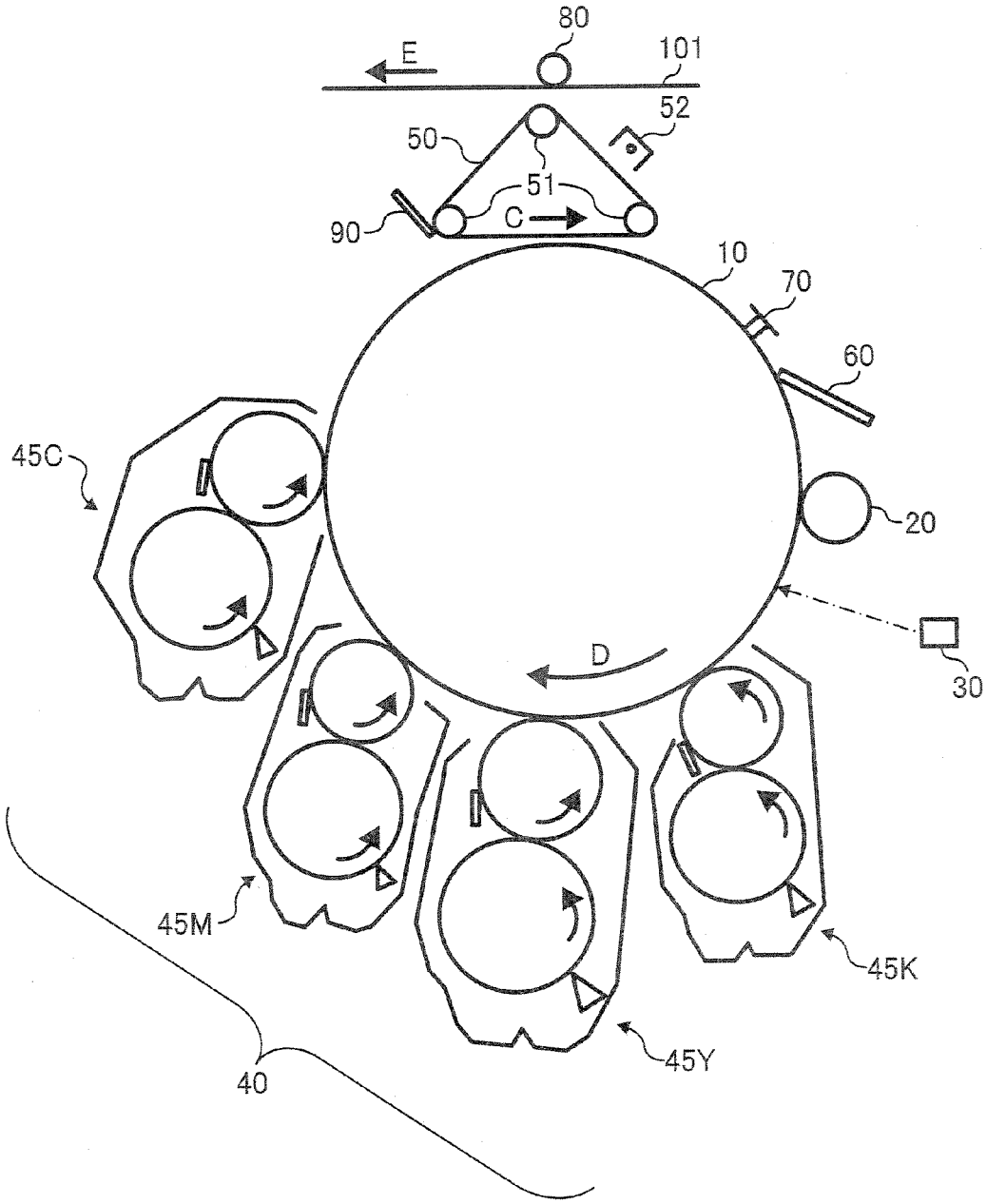
FIG. 2 is a schematic view illustrating an embodiment of the image forming apparatus of the present invention.

FIG. 2 is a schematic view illustrating an embodiment of the image forming apparatus of the present invention. Around a photoreceptor 10 serving as an image bearing member, a charging roller 20 serving as a charging means, a light irradiating means 30, a cleaning means 60 including a cleaning blade, a discharge lamp 70 serving as a discharging means, a developing means 40, and an intermediate transfer medium 50 are arranged. The intermediate transfer medium 50 is tightly stretched with suspension rollers 51 and is driven by a driving means such as a motor (not shown) so as to endlessly move in the direction indicated by an arrow C. A transfer bias voltage is applied from an electric source (not shown) to some of the suspension rollers 51 so that these rollers have a function of supplying a transfer bias to the intermediate transfer medium 50. Further, a cleaning means 90 including a cleaning blade for cleaning the intermediate transfer medium 50 is arranged close thereto. A transfer roller 80, serving as a transfer means for transferring a toner mage onto a transfer paper 101 serving as a final transfer medium, is arranged facing the intermediate transfer medium 50. A transfer bias is applied to the transfer roller 80 from an electric source (not shown). A corona charger 52 configured to charge a toner image on the intermediate transfer medium 50 is arranged around the intermediate transfer medium 50.

The developing means 40 includes a black developing unit 45K, a yellow developing unit 45Y, a magenta developing unit 45M, and a cyan developing unit 45C, arranged around the photoreceptor 10.

Next, the operation of the image forming apparatus illustrated in FIG. 2 will be explained. At first, the photoreceptor 10 is charged with the charging roller 20 while rotating in the direction indicated by an arrow D. The light irradiating means 30 forms an electrostatic latent image on the photoreceptor 10 by projecting a light reflected from an original document, which is formed by an optical system (not shown). The electrostatic latent image formed on the photoreceptor 10 is developed by the developing means 40 to form a toner image (i.e., visible image) thereon. The toner image is then transferred (i.e., primary transfer) onto the surface of the intermediate transfer medium 50 at a contact point (i.e., primary transfer area) between the photoreceptor 10 and the intermediate transfer medium 50, each of which rotates at a same rate. When plural toner images are overlaid, the above process is repeatedly performed so as to form a full-color image on the intermediate transfer medium 50.

The corona charger 52 configured to charge a full-color image formed on the intermediate transfer medium 50 is arranged on a downstream side from the contact point of the photoreceptor 10 and the intermediate transfer medium 50, and an upstream side from the contact point of the intermediate transfer medium 50 and the transfer paper 101 relative to the rotation direction of the intermediate transfer medium 50. The corona charger 52 supplies electric charge having a same polarity as that of the toner to the toner image so that then toner image can be transferred onto the transfer paper 101. The charged toner image is then transferred (i.e., secondary transfer) onto the transfer paper 101, fed from a paper feeding part (not shown) in the direction indicated by an arrow E, by application of a transfer bias from the transfer roller 80. The transfer paper 101 having the transferred toner image thereon is separated from the intermediate transfer medium 50 by a separation means (not shown), and then fixed by a fixing means (not shown) and discharged from the image forming apparatus. On the other hand, residual toner particles remaining on the photoreceptor 10 are removed therefrom by the cleaning means 60, and then the photoreceptor 10 is discharged by the discharge lamp 70 to be prepared for the next charging.

Figure 3:
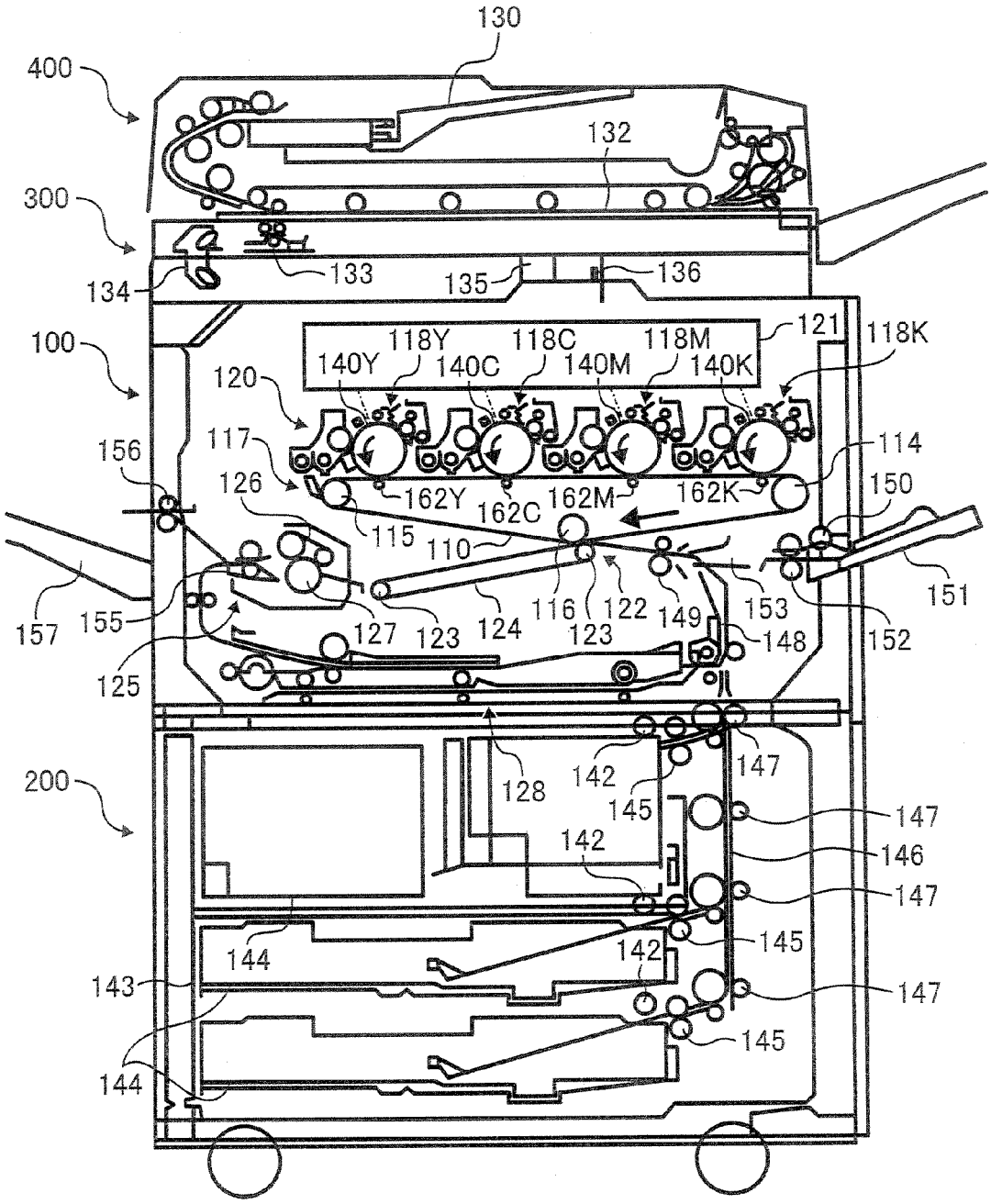
FIG. 3 is a schematic view illustrating another embodiment of the image forming apparatus of the present invention.

FIG. 3 is a schematic view illustrating another embodiment of the image forming apparatus of the present invention. The image forming apparatus illustrated In FIG. 3 is a tandem-type full-color image forming apparatus and includes a main body 100, a paper feeding table 200, a scanner 300, and an automatic document feeder (ADF) 400.

An intermediate transfer medium 110, which is an endless belt, is arranged in the center the main body 100. The intermediate transfer medium 110 is tightly stretched with support rollers 114, 115 and 116 to rotate in a clockwise direction. A cleaning device 117 configured to remove residual toner particles remaining on the intermediate transfer medium 110 is arranged on the left side of the support roller 115. A tandem-type image forming device 120 including image forming units 118Y, 118C, 118M and 118K is arranged facing the intermediate transfer medium 110. The image forming units 118Y, 118C, 118M and 118K are arranged in this order around the intermediate transfer medium 110 relative to the rotating direction thereof.

A light irradiator 121 is arranged above the tandem-type image forming device 120. A secondary transfer device 122 is arranged on the opposite side of the intermediate transfer medium 110 relative to the tandem-type image forming device 120. The secondary transfer device 122 includes a secondary transfer belt 124, which is an endless belt, tightly stretched with a pair of rollers 123. The secondary transfer device 122 is arranged pressing the support roller 116 with the intermediate transfer medium 110 therebetween so that a toner image formed on the intermediate transfer medium 110 is transferred onto a transfer paper.

A fixing device 125 configured to fix a transferred image on the transfer paper is arranged close to the secondary transfer device 122. The fixing device 125 includes a fixing belt 126 and a pressing roller 127 pressing the fixing belt 126.

The secondary transfer device 122 further has a function of feeding the transfer paper to the fixing device 125. Of course, the secondary transfer device 122 may include a transfer roller and a non-contact charger. In this case, it is difficult for the secondary transfer device 122 to have the function of feeding the transfer paper.

A reversing device 128 configured to reverse the transfer paper to form images on both sides thereof is arranged in parallel with the tandem-type image forming device 120 under the secondary transfer device 122 and the fixing device 125.

Next, procedure of forming a full-color image with the image forming apparatus illustrated in FIG. 3 will be explained.

An original document is set in a document feeder 130 included in the automatic document feeder (ADF) 400, or placed on a contact glass 132 included in the scanner 300.

When a start switch button (not shown) is pushed, the scanner 300 starts driving, and a first runner 133 and a second runner 134 start moving. When the original document is set in the document feeder 130, the scanner 300 starts driving after the original document is fed on the contact glass 132. The original document is irradiated with a light emitted by a light source via the f runner 133, and the light reflected from the original document is then reflected by a mirror included in the second runner 134. The light passes through an imaging lens 135 and is received by a reading sensor 136. Thus, image information of each color is read.

On the other hand, when the start switch button (not shown) is pushed, a driving motor (not shown) drives one of the support rollers 114, 115, and 116 and the others are driven thereby so that the intermediate transfer medium 110 rotates. Simultaneously, each image forming unit 118Y, 118C, 118M and 118K forms a single-color image (i.e., black, yellow, magenta, and cyan) on each photoreceptor. Each of the single-color images is transferred onto the intermediate transfer medium 110 one by one to form a full-color image thereon.

On the other hand, in the paper feeding table 200, a transfer paper is fed from one of multistage paper feeding cassettes 144, included in a paper bank 143, by rotating one of paper feeding rollers 142. The transfer paper is separated by a pair of separation rollers 145 and fed to a paper feeding path 146. Then the transfer paper is transported to a paper feeding path 148, included in the main body 100, by transport rollers 147, and is stopped by a registration roller 149.

When the transfer paper is fed from a manual paper feeder 151 by rotating a feeding roller 150, the transfer paper is separated by a separation roller 152 and fed to a manual paper Feeding path 153, and is stopped by the registration roller 149.

The transfer paper is timely fed to an area formed between the intermediate transfer medium 110 and the secondary transfer device 122, by rotating the registration roller 149, to meet the full-color toner image formed on the intermediate transfer medium 110. The full-color toner image is transferred onto the transfer paper by the secondary transfer device 122.

The transfer paper having the toner image thereon is transported from the secondary transfer device 122 to the fixing device 125. The toner image is fixed on the transfer pacer in the fixing device 125 upon receipt of neat and pressure. The transfer paper is switched by a switch pick 155 and ejected by an ejection roller 156 and then stacked on an ejection tray 157. When the transfer paper is switched by the switch pick 155 to be reversed in the reverse device 128, the transfer paper is fed to a transfer area again so that a toner image is formed on the backside thereof. And then the recording paper is ejected by the ejection roller 156 and stacked on the ejection tray 157.

On the other hand, residual toner particles remaining on the intermediate transfer medium 110 are removed therefrom by the cleaning device 117, and then the intermediate transfer medium 110 is prepared for the next image forming operation.

The registration roller 149 is typically grounded, however, a bias can be applied thereto in order to remove a paper powder therefrom.

Figure 4:
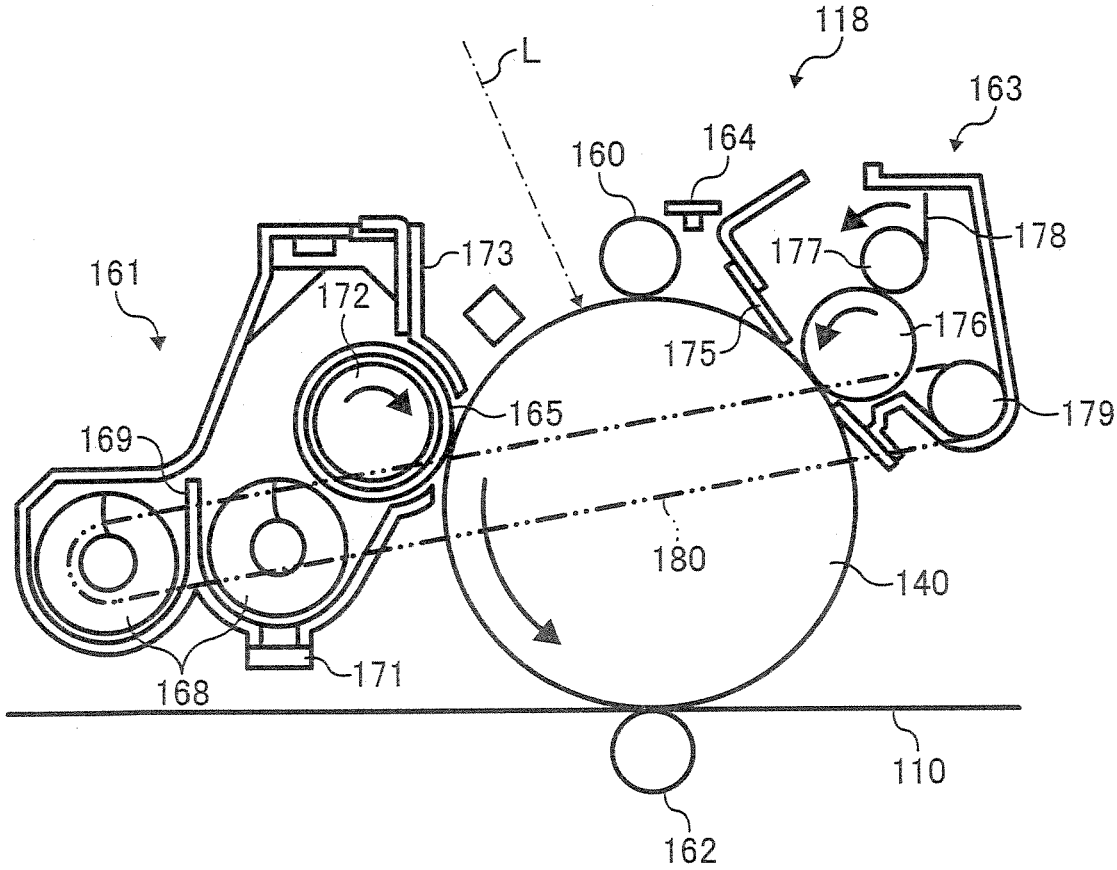
FIG. 4 is a schematic view illustrating an embodiment of the image forming unit of the image form apparatus illustrated in FIG. 3.

FIG. 4 is a schematic view illustrating an embodiment of the image forming units 118Y, 118C, 118M and 118K. Since the image forming units 118Y, 118C, 118M and 118K have the same configurations, only one image forming unit is illustrated in FIG. 4. Symbols Y, C, M and K, which represent each of the colors, are omitted from the reference number.

Around a photoreceptor 140, a charging device 160, a developing device 161, a primary transfer device 162, a photoreceptor cleaning device 163, a discharging device 164, etc. are arranged. A reference number 165 represents a developer present on a developing sleeve 172, 168 represents an agitation paddle, 169 represents a division plate, 171 represents a toner concentration sensor, 173 represents a doctor blade, 175 represents a cleaning blade, 176 represents a cleaning brush, 177 represents a cleaning roller, 178 represents a cleaning blade, 179 represents a toner discharging auger, and 180 represents a drive device.

The toner of the present invention is preferably fixed using an oilless fixing method in which a recording material (such as a paper) bearing a toner image thereon is passed through a nip formed between a heating member (such as a heating roller) and a pressing member or a heat-pressing member contacting the heating member with pressure.

The surface of the heating member preferably includes fluorocarbon resins such as PFA (tetrafluoroethylene-perfluoroalkyl vinyl ether copolymer), PTFE (poly(tetrafluoroethylene)), PVDF (poly(vinylidene fluoride)), etc.

Figure 5:
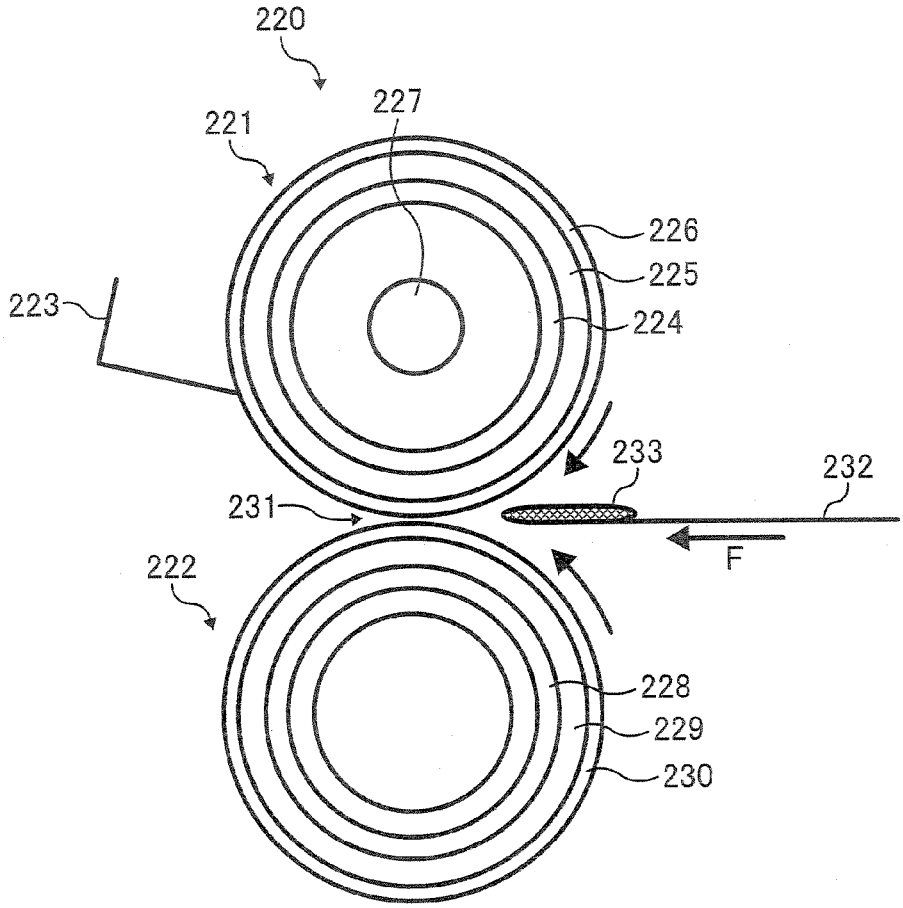
FIG. 5 is a schematic view illustrating an embodiment of the fixing device for use in the image forming apparatus of the present invention.

FIG. 5 is a schematic view illustrating an embodiment of the fixing device for use in the image forming apparatus of the present invention.

A fixing device 220 includes a heating roller 221 serving as a heating member, a pressing roller 222 serving as a pressing member and contacting the heating roller 221 with pressure, and a separation plate 223 configured to separate a recording sheet having a fixed toner image thereon from the heating roller 221. The heating roller 221 includes an aluminum cored bar 224, an elastic layer 225 located on the aluminum cored bar 224, an outermost layer 226 located on the elastic layer 225, and a heater 227 located inside the aluminum cored bar 224. The pressing roller 222 includes an aluminum cored bar 228, an elastic layer 229 located on the aluminum cored bar 228, and an outermost layer 230 located on the elastic layer 229. The elastic layers 225 and 229 are preferably made of a silicone rubber, but are not limited thereto. The outermost layers 226 and 230 are preferably made of a fluorocarbon resin, more preferably a PFA, but are not limited thereto.

A nip 231 is formed between the heating roller 221 and the pressing roller 222. The nip 231 is preferably convex upward in terms of improving separativeness between the heat roller 221 and a recording sheet 232. In other words, the recording sheet 232 having a toner image 233 thereon is prevented from winding around the heating roller 221 when the toner image 233 is fixed. The fixing is performed by passing the recording sheet 232 having the toner image 233 thereon through the nip 231 in a direction indicated by an arrow F.

The toner of the present invention can produce high quality images having good reproducibility by using such oilless fixing device.

Process Cartridge

The process cartridge of the present invention includes an image bearing member configured to bear an electrostatic latent image and a developing means for developing the electrostatic latent image with a developer to form a visible image, and optionally includes a light irradiating means, a transfer means, a cleaning means, etc.

Figure 6:
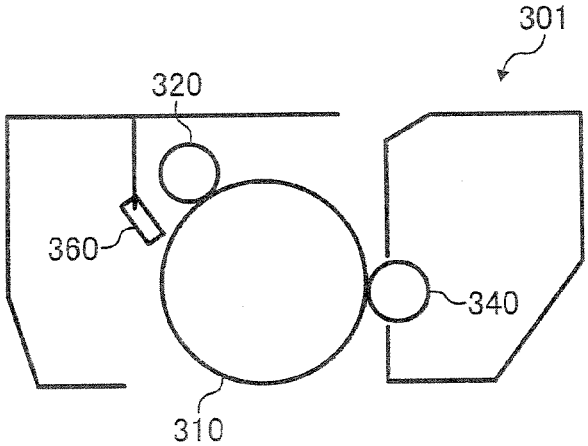
FIG. 6 is a schematic view illustrating an embodiment of the process cartridge of the present invention.

FIG. 6 is a schematic view illustrating an embodiment of the process cartridge of the present invention. A process cartridge 301 includes a photoreceptor 310, a charging device 320, a developing device 340, and a cleaning device 360. The process cartridge 301 is detachably attachable to image forming apparatuses such as copiers and printers.

The photoreceptor 310 rotates at a predetermined speed, and the surface thereof is charged to have a positive or negative predetermined potential by the charging device 320 while rotating. The photoreceptor 310 is irradiated with a light emitted by a light irradiator (such as a slit irradiator, a laser beam scanning irradiator, etc.) to form an electrostatic latent image thereon. The electrostatic latent image is developed with a toner in the developing device 340, and then the toner image is transferred onto a transfer material, which is timely fed from a paper feeding part to an area formed between the photoreceptor 310 and a transfer device in order to meet the toner images on the photoreceptor 310. The transfer material having the toner images thereon is separated form the photoreceptor 310 and transported to a fixing device so that the toner image is fixed on the transfer material and the transfer material is discharged from the image forming apparatus as a copying or a printing. After the toner image is transferred, residual toner particles remaining on the photoreceptor 310 are removed therefrom by the cleaning device 360, and then the photoreceptor 310 is discharged. The photoreceptor 310 is repeatedly used.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Resin Composition (H1)

The following components are fed in a dropping funnel.

| | |
|---|---|
| Styrene (vinyl monomer) | 600 parts |
| Butyl acrylate (vinyl monomer) | 110 parts |
| Acrylic acid (vinyl monomer) | 30 parts |
| Dicumyl peroxide (polymerization initiator) | 30 parts |

The following components are fed in a reaction vessel equipped with a thermometer, a stainless stirrer, a condenser, and a nitrogen inlet pipe.

| | |
|---|---|
| Polyoxypropylene(2.2)-2,2-bis(4-hydroxyphenyl)propane (polyol) | 1230 parts |
| Polyoxyethylene(2.2)-2,2-bis(4-hydroxyphenyl)propane (polyol) | 290 parts |

-continued

| | |
|---|---|
| Isododecenyl succinic anhydride (polycarboxylic acid) | 250 parts |
| Terephthalic acid (polycarboxylic acid) | 310 parts |
| 1,2,4-Benzenetricarboxylic acid anhydride (polycarboxylic acid) | 180 parts |
| Dibutyl tin oxide (esterification catalyst) | 7 parts |
| Paraffin wax W1 | 460 parts |

(The paraffin wax W1 has a melting point of 73.3° C. and a half bandwidth of 3.9° C. which is determined from an endothermic peak determined by DSC at a temperature rising scan. The amount of the paraffin wax W1 is 15.1 parts by weight based on 100 parts by weight of the polyester monomers.)

The mixture contained in the reaction vessel is agitated at 160° C. in nitrogen atmosphere, while the mixture of the vinyl monomers and the polymerization initiator is dropped therein from the dropping funnel over a period of 1 hour. The mixture is further subjected to an addition polymerization reaction for 2 hours at 160° C., and then the mixture is heated to 230° C. so as to be subjected to a condensation polymerization reaction. The polymerization degree of the product is traced by measuring a softening point ($T_{1/2}$) using a constant-pressure extrusion capillary rheometer. The reaction is stopped when the product has a desired softening point.

Thus, a resin composition (H1) is prepared.

Preparations of Resin Compositions (H2), (H3), (H5) to (H10), and (L2)

The procedure for preparation of the resin composition (H1) is repeated except for changing the components to those for resin compositions (H2), (H3), (H5) to (H10), and (L2) described in Table 1, respectively.

Thus, resin compositions (H2), (H3), (H5) to (H10), and (L2) are prepared.

Preparation of Resin Composition (H4)

The following components are fed in a reaction vessel equipped with a thermometer, a stainless stirrer, a condenser, and a nitrogen inlet pipe.

| | |
|---|---|
| Polyoxypropylene(2.2)-2,2-bis(4-hydroxyphenyl)propane (polyol) | 2210 parts |
| Terephthalic acid (polycarboxylic acid) | 850 parts |
| 1,2,4-Benzenetricarboxylic acid anhydride (polycarboxylic acid) | 120 parts |
| Dibutyl tin oxide (esterification catalyst) | 0.5 parts |
| Paraffin wax W1 | 350 parts |

(The paraffin wax W1 has a melting point of 73.3° C. and a half bandwidth of 3.9° C. which is determined from an endothermic peak determined by DSC at a temperature rising scan. The amount of the paraffin wax W1 is 11.0 parts by weight based on 100 parts by weight of the polyester monomers.)

The mixture is heated to 230°≡ C. in nitrogen atmosphere so as to be subjected to a condensation polymerization reaction. The polymerization degree of the product is traced by measuring a softening point ($T_{1/2}$) using a constant-pressure extrusion capillary rheometer. The reaction is stopped when the product has a desired softening point.

Thus, a resin composition (H4) is prepared.

Preparation of Resin Composition (L1)

The procedure for preparation of the resin composition (H4) is repeated except for changing the components to those for resin composition (L1) described in Table 1.

Thus, a resin composition (L1) is prepared.

TABLE 1

| Resin composition | Vinyl monomers (g) St | BA | 2EHA | AA | Polymerization initiator (g) DCPO | Polyols and polycarboxylic acids (g) BPA-PO | EO | i-DSA | TPA | TMA | Catalyst (g) DBTO | Wax Name | Added Amount (g) | Weight ratio to monomers (%) | T½ (° C.) |
|---|---|---|---|---|---|---|---|---|---|---|---|---|---|---|---|
| H1 | 600 | 110 | — | 30 | 30 | 1230 | 290 | 250 | 310 | 180 | 7 | W1 | 460 | 15.1 | 130 |
| H2 | 520 | 60 | 70 | 25 | 25 | 1100 | 130 | 290 | 250 | 150 | 7 | W1 | 750 | 28.5 | 142 |
| H3 | 590 | — | 120 | 30 | 30 | 1260 | 130 | 200 | 380 | 270 | 7 | W1 | 250 | 8.3 | 124 |
| H4 | — | — | — | — | — | 2210 | — | — | 850 | 120 | 0.3 | W1 | 350 | 11.0 | 137 |
| H5 | 710 | 130 | — | 40 | 40 | 1450 | 340 | 290 | 360 | 210 | 0.5 | — | — | — | 130 |
| H6 | 600 | 110 | — | 30 | 30 | 1230 | 290 | 250 | 310 | 180 | 7 | W2 | 460 | 15.1 | 131 |
| H7 | 600 | 110 | — | 30 | 30 | 1230 | 290 | 250 | 310 | 180 | 7 | W3 | 460 | 15.1 | 131 |
| H8 | 710 | 130 | — | 40 | 40 | 1450 | 340 | 290 | 360 | 210 | 0.5 | — | — | — | 145 |
| H9 | 520 | 60 | 70 | 25 | 25 | 1100 | 130 | 290 | 250 | 150 | 7 | W1 | 1000 | 38.1 | 140 |
| H10 | 590 | — | 120 | 30 | 30 | 1260 | 130 | 200 | 380 | 270 | 7 | W1 | 150 | 5.0 | 123 |
| L1 | — | — | — | — | — | 1650 | 660 | 190 | 750 | 190 | 0.3 | — | — | — | 113 |
| L2 | 610 | — | 60 | 30 | 30 | 1610 | 170 | 260 | 480 | 340 | 0.3 | — | — | — | 117 |

The abbreviated names of the monomers, catalyst, initiator, and waxes are as follows.

St: Styrene

BA: Butyl Acrylate

2EHA: 2-Ethylhexyl acrylate

AA: Acrylic acid

DCPO: Dicumyl peroxide

BPA-PO: Polyoxypropylene(2.2)-2,2-bis(4-hydroxyphenyl)propane

PBA-EO: Polyoxyethylene(2.2)-2,2-bis(4-hydroxyphenyl)propane i-DSA: Isododecenyl succinic anhydride TPA: Terephthalic acid TMA: Trimellitic anhydride W1: Paraffin wax (having a melting point of 73.0° C. and a half bandwidth of 3.9° C.)

W2: Polyethylene wax (having a melting point of 76.2° C. and a half bandwidth of 8.8° C.)

W3: Carnauba wax (having a melting point of 81.0° C. and a half bandwidth of 6.0° C.)

Example 1

The following components are mixed with a blender

| | |
|---|---|
| Resin composition (H1) | 30 parts |
| Resin composition (L1) | 70 parts |
| Charge controlling agent (metal salt of salicylic acid derivative) | 1 part |

-continued

| | |
|---|---|
| Colorant (copper phthalocyanine blue pigment) | 2.5 parts |

The mixture is kneaded with a double-axis extruder, and then cooled and pulverized. The pulverized particles are classified. Thus, mother toner particles having a volume average particle diameter of 7.5 μm are prepared.

Next, 100 parts by weight of the mother toner particles are mixed with 0.4 parts of a hydrophobized silica (which is surface-treated with hexamethyldisilazane and having a primary particle diameter of 0.02 μm) using a HENSCHEL MIXER. Thus, a toner (1) is prepared.

The toner (1) has an acid value of 22.4 mgKOH/g, $T_{1/2}$ of 120° C., $T_{end}$ of 127° C., and an average circularity of 0.922.

Examples 2 to 6, and 8

The procedure for preparation of the toner (1) is repeated except for changing the components to those for toners (2) to (6), and (8), respectively, described in Table 2.

Thus, toners (2) to (6), and (8) are prepared.

Comparative Examples 1 to 5

The procedure for preparation of the toner (1) is repeated except for changing the components to those for comparative toners (101) to (105), respectively, described in Table 2.

Thus, toners (101) to (105) are prepared.

TABLE 2

| Example | Toner | First resin composition | | Second resin composition | | Third resin composition | | Wax | |
|---|---|---|---|---|---|---|---|---|---|
| | | Name | Added amount (parts by weight) | Name | Added amount (parts by weight) | Name | Added amount (parts by weight) | Name | Added amount (parts by weight) |
| Ex. 1 | (1) | H1 | 30 | L1 | 70 | — | — | — | — |
| Ex. 2 | (2) | H2 | 15 | L1 | 85 | — | — | — | — |
| Ex. 3 | (3) | H3 | 45 | L1 | 55 | — | — | — | — |
| Ex. 4 | (4) | H4 | 35 | L1 | 65 | — | — | — | — |
| Ex. 5 | (5) | H4 | 40 | L1 | 50 | L2 | 10 | — | — |
| Ex. 6 | (6) | H6 | 30 | L1 | 70 | — | — | — | — |
| Ex. 8 | (8) | H1 | 29 | L1 | 70 | — | — | W2 | 1 |
| Comp. Ex. 1 | (101) | H5 | 26 | L1 | 70 | — | — | W1 | 4 |
| Comp. Ex. 2 | (102) | H8 | 40 | L1 | 56 | — | — | W1 | 2 |
| Comp. Ex. 3 | (103) | H9 | 12 | L1 | 88 | — | — | — | — |
| Comp. Ex. 4 | (104) | H10 | 75 | L1 | 25 | — | — | — | — |
| Comp. Ex. 5 | (105) | H7 | 30 | L1 | 70 | — | — | — | — |

Example 7

(1) Preparation of Colorant Dispersion

The following components are mixed using a sand grinder mill.

| | |
|---|---|
| Pigment (C.I. Pigment Blue 15:3) | 50 parts |
| Sodium dodecyl sulfate | 10 parts |
| Ion-exchange water | 200 parts |

Thus, a colorant dispersion containing colorant particles having a volume average particle diameter (D50) of 170 nm is prepared.

(2) Preparation of Latex (1L)

In a 5000 ml separable flask equipped with a stirrer, a thermometer, a condenser, and a nitrogen inlet pipe, 4.05 parts of sodium dodecyl sulfate and 2500 parts of ion-exchange water are contained and heated to 80° C. while agitated at a revolution of 230 rpm under nitrogen airflow. Thus, a dispersion medium is prepared.

Next, 200 parts of a polymerization initiator liquid, in which 9.62 parts of a polymerization initiator (potassium peroxide) are dissolved in 200 parts of ion-exchange water, are added to the dispersion medium prepared above.

The following components are mixed to prepare a monomer liquid.

| | |
|---|---|
| Styrene | 612 parts |
| n-Butyl acrylate | 156 parts |
| Methacrylic acid | 32 parts |
| n-Octyl mercaptan | 13 parts |

The monomer liquid is added to the dispersion medium containing the polymerization initiator over a period of 90 minutes. The mixture is heated to 80° C. and agitated for 2 hours so as to be subjected to a first polymerization. Thus, a latex (1L) is prepared.

The dried latex (1L) has a $T_{1/2}$ of 124° C.

(3) Preparation of Latex (1HML)

(3-1) Preparation of Core Particles (First Polymerization)

In a 5000 ml separable flask equipped with a stirrer, a thermometer, a condenser, and a nitrogen inlet pipe, 4.05 parts of sodium dodecyl sulfate and 2500 parts of ion-exchange water are contained and heated to 80° C. while agitated at a revolution of 230 rpm under nitrogen airflow. Thus, a dispersion medium (1) is prepared.

Next, 200 parts of a polymerization initiator liquid, in which 9.62 parts of a polymerization initiator (potassium peroxide) are dissolved in 200 parts of ion-exchange water, are added to the dispersion medium (1) prepared above.

The following components are mixed to prepare a monomer liquid (1).

| | |
|---|---|
| Styrene | 568 parts |
| n-Butyl acrylate | 164 parts |
| Methacrylic acid | 68 parts |
| n-Octyl mercaptan | 16.51 parts |

The monomer liquid (1) is added to the dispersion medium (1) containing the polymerization initiator over a period of 90 minutes. The mixture is heated to 80° C. and agitated for 2 hours so as to be subjected to a first polymerization. Thus, a latex (1H) is prepared.

The latex (1H) has a weight average particle diameter of 68 nm.

(3-2) Preparation of Intermediate Layer (Second Polymerization)

The flowing components are fed in a flask equipped with a stirrer.

| | |
|---|---|
| Styrene | 123.81 parts |
| n-Butyl acrylate | 39.51 parts |
| Methacrylic acid | 12.29 parts |

-continued

| | |
|---|---|
| n-Octyl mercaptan | 0.72 parts |
| Wax W1 | 75.0 parts |

The mixture is heated to 80° C. and agitated. Thus, a monomer liquid (2) is prepared.

A dispersion medium (2), in which 0.60 parts of $C_{10}H_{21}(OCH_2CH_2)_2OSO_3Na$ are dissolved in 2700 parts of ion-exchange water, is heated to 98° C. Then 32 parts (on a solid basis) of the latex (1H) containing core particles are added thereto. The monomer liquid (2) is further added thereto and subjected to a dispersion treatment for 8 hours using a mechanical dispersing machine CLEARMIX® (manufactured by M TECHNIQUE Co., Ltd.). Thus, a dispersion (i.e., an emulsion) containing emulsified particles (i.e., oil droplets) is prepared.

Next, a polymerization initiator liquid, in which 6.12 parts of a polymerization initiator (potassium peroxide) are dissolved in 250 parts of ion-exchange water, is added to the dispersion (i.e., the emulsion) prepared above. The mixture is heated to 82° C. and agitated for 12 hours so as to be subjected to a second polymerization. Thus, a latex (1HM) containing composite resin particles, in which the surfaces of the core particles of the latex (1H) are covered with the secondly polymerized resin, is prepared.

(3-3) Preparation of Outer Layer (Third Polymerization)

The following components are fed in a flask equipped with a stirrer.

| | |
|---|---|
| Styrene | 350 parts |
| n-Butyl acrylate | 95 parts |
| Methacrylic acid | 5 parts |
| n-Octyl mercaptan | 6.1 parts |

The mixture is heated to 80° C. and agitated. Thus, a monomer liquid (3) is prepared.

A polymerization initiator liquid, in which 8.8 parts of a polymerization initiator (KPS) are dissolved in 350 parts of ion-exchange water, is added to the latex (1HM) prepared above. The mixture is heated to 82° C., and the monomer liquid (3) is added thereto over a period of 1 hour. The mixture is further heated and agitated for 2 hours so as to be subjected to a third polymerization, and then cooled to 28° C. Thus, a latex (1HML) containing composite resin particles, formed of a core consisting of core particle of the latex (1H), an intermediate layer consisting of the secondly polymerized resin and the wax, and an outer layer consisting of the thirdly polymerized resin, is prepared.

The latex (1HML) includes the wax W1 in an amount of 12.5% by weight based on total weight of the monomers, and the dried latex (1HML) has a $T_{1/2}$ of 131° C.

(4) Preparation of Toner

In reaction vessel (i.e. four-neck flask) equipped with a thermometer, a condenser, a nitrogen inlet pipe, and a stirrer, the following components are contained and agitated.

| | |
|---|---|
| Latex (1L) | 240 parts (on a solid basis) |
| Latex (1HML) | 180 parts (on a solid basis) |
| Ion-exchange water | 900 parts |
| Colorant dispersion | 150 parts |

The mixture is controlled to have a temperature of 30° C., and then a 5N aqueous solution of NaOH is added thereto so that the mixture has a pH of from 8 to 10.

Next, an aqueous solution, in which 65 parts of magnesium chloride hexahydrate are dissolved in 1000 parts of ion-exchange water, is added to the mixture over a period of 10 minutes at 30° C. while agitated. The mixture is left for 3 minutes, and then heated to 92° C. to produce aggregated particles. The mixture is subjected to a measurement using COULTER COUNTER II to determine the particle diameters of the aggregated particles. When the aggregated particles have a number average particle diameter of 6.6 μm, an aqueous solution, in which 80.4 parts of sodium chloride are dissolved in 1000 parts of ion-exchange water, is added to the mixture to terminate the growth of the aggregated particles. The mixture is further heated to 94° C. and agitated so that the aggregated particles are fused and crystalline materials are phase-separated (i.e., aging process). The mixture is subjected to a measurement using FPIA-2000 to determine the shapes of the fused particles. When the fused particles have an average circularity of 0.952, the mixture is cooled to 30° C. and the agitation is stopped. The mixture is filtered to obtain fused particles. The fused particles are repeatedly washed with ion-exchange water having a temperature of 45° C., and then dried with a hot air having a temperature of 40° C. Thus, mother toe particles are prepared.

The mother toner particles have a number average particle diameter of 6.5 μm and an average circularity of 0.954.

Next, 100 parts of the mother toner particles are mixed with 0.4 parts of a hydrophobized silica (which is surface-treated with hexamethyldisilazane and having a primary particle diameter of 0.02 μm) using a HENSCHEL MIXER. Thus, a toner (7) is prepared.

The toner (7) has an acid value of 25.1 KOHmg/g, $T_{1/2}$ of 127° C., and $T_{end}$ of 135° C.

Comparative Example 6

In a reaction vessel (i.e., four-neck flask) equipped with a thermometer, a condenser, a nitrogen inlet pipe, and a stirrer, the following components are contained and agitated.

| | |
|---|---|
| Latex (1HML) | 420 parts (on a solid basis) |
| Ion-exchange water | 900 parts |
| Colorant dispersion | 150 parts |

The mixture is controlled to have a temperature of 30° C., and then a 5N aqueous solution of NaOH is added thereto so that the mixture has a pH of from 8 to 10.

Next, an aqueous solution, in which 65 parts of magnesium chloride hexahydrate are dissolved in 1000 parts of ion exchange water, is added to the mixture over a period of 10 minutes at 30° C. while agitated. The mixture is left for 3 minutes, and then heated to 92° C. to produce aggregated articles. The mixture is subjected to a measurement using COULTER COUNTER II to determine the particle diameters of the aggregated particles. When the aggregated particles have a number average particle diameter of 6.6 μm, an aqueous solution, in which 80.4 parts of sodium chloride are dissolved in 1000 parts of ion-exchange water, is added to the mixture to terminate the growth of the aggregated particles. The mixture is further heated to 94° C. and agitated so that the aggregated particles are fused and crystalline materials are phase-separated (i.e., aging process). The mixture is subjected to a measurement using FPIA-2000 to determine the shapes of the fused particles. When the fused particles have an average circularity of 0.952, the mixture is cooled to 30° C. and the agitation is stopped. The mixture is filtered to obtain fused particles. The fused particles are repeatedly washed with ion-exchange water having a temperature of 45° C., and then dried with a hot air having a temperature of 40° C. Thus, mother toner particles are prepared.

The mother toner particles have a number average particle diameter of 6.5 μm and an average circularity of 0.953.

Next, 100 parts of the mother toner particles are mixed with 0.4 parts of a hydrophobized silica (which is surface-treated with hexamethyldisilazane and having a primary particle diameter of 0.02 μm) using a HENSCHEL MIXER. Thus, a comparative toner (106) is prepared.

The comparative toner (106) has an acid value of 25.6 KOHmg/g, $T_{1/2}$ of 132° C., and $T_{end}$ of 140° C.

Evaluations 1

(1-a) $T_{1/2}$ Temperature and $T_{end}$ Temperature

The ½ method temperature ($T_{1/2}$) and the flow end temperature ($T_{end}$) of a resin and a toner are determined using SHIMADZU FLOWTESTER CFT-500D (manufactured by Shimadzu Corporation). The flow test is performed under the following conditions.

Die diameter: 0.5 mm

Die length: 1 mm

Temperature rising speed: 3° C./min

Load: 30 KgF (1-b) Melting Point of Wax

The melting point of a wax is determined using a differential scanning calorimeter DSC6200 (manufactured by Seiko Instrument Inc.). A sample is firstly heated to 200° C., and then cooled to 0° C. at a temperature decreasing rate of 10° C./min and then heated again at a temperature rising rate of 10° C./min.

(1-c) Acid Value

The acid value of a resin is determined based on JIS K-0070 as follows:

(1) a sample is fed into a 300 ml beaker, and mixed with 150 ml of a mixture liquid in which toluene and ethanol are mixed at a volume ratio (i.e., toluene/ethanol) of 4/1 so that the sample is dissolved therein;

(2) the sample liquid is titrated with a 0.1 mol/l ethanol solution of KOH, using a potentiometric titrator (e.g., an automatic potentiometric titrator AT-400 equipped with an automatic burette APB-400, both manufactured by Kyoto Electronics Manufacturing Co., Ltd.); and (3) an acid value is calculated from the following equation:

$$AV(\text{mgKOH/g})=\{(S-B)\times f\times 5.61\}/W$$

wherein S (ml) represents a consumed amount of the KOH solution in the titration of the sample, B (ml) represents a consumed amount of the KOH solution in the titration of the blank, f represents the factor of KOH, and W (g) represents an amount of the sample.

(1-d) Particle Diameter

The volume average particle diameter (Dv), number average particle diameter (Dn) and particle diameter distribution of a toner can be measured using an instrument COULTER COUNTER TA-II, COULETR MULTISIZER II, or COULETR MULTISIZER III from Coulter Electrons Inc.

The typical measuring method is as follows:

(1) 0.1 to 5 ml of a surfactant (preferably alkylbenzene sulfonate) is included as a dispersant in 100 to 150 ml of an electrolyte (i.e., 1% aqueous solution of a first grade sodium chloride, such as ISOTON-II from Coulter Electrons Inc.);

(2) 2 to 20 mg of a toner is added in the electrolyte, and then the toner is dispersed therein using an ultrasonic dispersing machine for about 1 to 3 minutes to prepare a toner dispersion liquid;

(3) a volume and a number of the toner particles are measured by the above instrument using an aperture of 100 μm to determine volume and number distribution thereof; and (4) the volume average particle diameter (Dv) and the weight average particle diameter (Dn) are determined.

In the Examples of the present invention, the measuring method is as follows:

(1) 5 mg of a toner is added in 100 ml of an electrolyte (ISOTON-II from Coulter Electrons Inc.), and then the toner is dispersed therein using an ultrasonic dispersing machine for 3 minutes to prepare a toner dispersion liquid;

(2) a volume and a number of the toner particles are measured by the above instrument using an aperture of 100 μm to determine volume and number distribution thereof; and (3) the volume average particle diameter (Dv) and the weight average particle diameter (Dn) are determined.

(1-e) Average Circularity

The shape of a toner particle is preferably determined by an optical detection method in which an image of the toner particle is optically detected by a CCD camera and analyzed. A toner particle suspension is passes the imaging detector located on the flat plate so as to be detected.

The circularity of a particle is determined by the following equation:

$$\text{Circularity}=Cs/Cp$$

wherein Cp represents the length of the circumference of the image of a particle and Cs represents the length of the circumference of a circle having the same area as that of the image of the particle.

The toner of the present invention preferably has an average circularity of from 0.890 to 0.950. When the average circularity is too small, transferability of the toner deteriorates and therefore images produced thereby have poor image quality. When the average circularity is too large, cleanability of the toner deteriorates and therefore images produced thereby have poor image quality.

The average circularity of a toner can be determined using a flow-type particle image analyzer FPIA-2100 (manufactured by Sysmex Corp.) and an analysis software FPIA-2100 Data Processing Program for FPIA version 00-10.

The typical measuring method is as follows:

(1) 0.1 g to 0.5 g of a sample to be measured are mixed with 100 to 150 ml of ion-exchange water, in which solid impurities are removed, including 0.1 ml to 0.5 ml of a dispersant (i.e., a surfactant, preferably a 10% by weight of an aqueous solution of an alkylbenzene sulfonic acid salt);

(2) the mixture is dispersed using an ultrasonic dispersing machine for 1 to 3 minutes to prepare a suspension including particles of 3,000 to 10,000 per micro-liter of the suspension; and (3) the average circularity and circularity distribution of the sample in the suspension are determined by the measuring instrument mentioned above.

In the Examples of the present invention, the measuring method is as follows:

(1) 0.3 g of a sample to be measured is mixed with 100 ml of ion-exchange water, in which solid impurities are removed, including 0.3 ml of a 10% by weight of an aqueous solution of an alkylbenzene sulfonic acid salt;

(2) the mixture is dispersed using an ultrasonic dispersing machine for 3 minutes; and (3) the average circularity and circularity distribution of the sample in the suspension are determined by the measuring instrument mentioned above.

(1-f) Separativeness

A two-component developer, in which 5 parts of a toner and 95 parts of a silicone-coated carrier are mixed, is set in a modified full-color printer IPSIO CX7500 (manufactured and modified by Ricoh Co., Ltd.) from which the fixing device is detached. The modified full-color printer is adjusted so that a solid image having 1.0 to 1.2 mg/cm$^2$ of the toner thereon is developed on a paper having a cross direction (TYPE 6200 from Ricoh Co., Ltd.) at a position of 3 mm behind the tip thereof while the paper is fed in the vertical direction, and 6 sheets of the paper having an unfixed image thereon are produced.

The fixing device detached from a full-color printer IPSIO CX2500 (manufactured by Ricoh Co., Ltd.) was modified so that the temperature and the linear speed of the fixing belt are variable. Each of the unfixed images prepared above is fixed from the tip portion (i.e., 3 mm-wide margin) thereof using the modified fixing device at a linear speed of 125 mm/sec and a temperature of from 140 to 190° C. in increments of 10° C., respectively. The separativeness is evaluated by the number of sheets in which the unfixed image is normally fixed without occurrence of problems that a paper is wound around the fixing belt, a paper is jammed like an accordion at the exit of the fixing device, etc. The separativeness is graded as follows.

Very good: 6 sheets are normally fixed.

Good: 5 sheets are normally fixed.

Average: 3 to 4 sheets are normally fixed.

Poor: 2 or less sheets are normally fixed.

(1-g) Fixing Strength

A two-component developer, in which 5 parts of a toner and 95 parts of a silicone-coated carrier are mixed, is set in a modified full-color printer IPSIO CX7500 (manufactured and modified by Ricoh Co., Ltd.) from which the fixing device is detached. The modified full-color printer is adjusted so that a solid image having 1.0 to 1.2 mg/cm$^2$ of the toner thereon is developed on a paper having a cross direction (TYPE 6200 from Ricoh Co., Ltd.) at a position of 100 mm behind the tip thereof while the paper is fed in the vertical direction, and the paper having an unfixed image thereon are produced.

The fixing device detached from a full-color printer IPSIO CX2500 (manufactured by Ricoh Co., Ltd.) is modified so that the temperature and the linear speed of the fixing belt are variable. The unfixed image prepared above is fixed using the modified fixing device at a linear speed of 125 mm/sec and a temperature of 140° C. The fixed image is subjected to a drawing test using an automatic drawing tester AD-401 (manufactured by Ueshima Seisakusyo Co., Ltd.) that a sapphire stylus 125 μR moves on the fixed image at a rotating diameter of 8 mm and a load of 1 g. The image is visually observed to determine the condition of scratches (i.e., traces) made by the sapphire stylus. The fixing strength is graded as follows.

Very good: Scratches are not recognized.

Good: Scratches are slightly recognized.

Average: Scratches are slightly recognized when the image is observed immediately above, but scratches are not apparently recognized when the image is observed from an angle of 45°.

Poor: Scratches are apparently recognized when the image is observed immediately above.

(1-h) Image Glossiness

Similarly to the evaluation of the fixing strength, the unfixed image is fixed using the modified fixing device at a linear speed of 125 mm/sec and a temperature of 160° C. The glossiness of the fixed image is measured with a gloss meter (manufactured by Nippon Denshoku industries Co., Ltd.) at a light entry angle of 60°. Full-color images used in offices preferably have a glossiness of from 5 to 15%.

(1-i) Toner Adhesion

A running test in which 2,000 sheets of a printing pattern having a printing proportion of 6% are continuously produced is performed at 23° C. and 45% RH using a full-color printer CX3000 (manufactured by Ricoh CO., Ltd.). After the running test, the developing roller and the image produced are visually observed and evaluated as follows.

Very good: No striped pattern and patchy unevenness of a toner are observed on the developing roller.

Good: A small amount of striped pattern and patchy unevenness of a toner is observed on the developing roller, but no striped pattern is observed in the image produced. No problem in practical use.

Poor: A large amount of striped pattern and patchy unevenness of a toner is observed on the developing roller, and striped hollow defect is also observed in the image produced. Having a problem in practical use.

(1-j) Toner filming

After the running test performed in the evaluation of the toner adhesion, the photoreceptor and the intermediate transfer member are visually observed and evaluated as follows.

Very good: No toner film is observed both on the photoreceptor and the intermediate transfer member.

Good: Toner film is observed either on the photoreceptor or on the intermediate transfer member, but the produced image was normal.

Poor: Toner film is observed either or both of the photoreceptor or on the intermediate transfer member, and the produced image is abnormal.

The properties of the prepared toners are shown in Table 3, and the evaluation results are shown in Table 4.

TABLE 3

| Example | Toner | Wax | Added amount of wax (% by weight) | $T_{1/2}$ (° C.) | $T_{end}$ (° C.) | Acid value (mgKOH/g) | Volume average particle diameter (μm) | Average circularity |
|---|---|---|---|---|---|---|---|---|
| Ex. 1 | (1) | Paraffin | 4.5 | 120 | 127 | 22.4 | 7.5 | 0.922 |
| Ex. 2 | (2) | Paraffin | 4.3 | 119 | 125 | 23.0 | 7.8 | 0.927 |

TABLE 3-continued

| Example | Toner | Wax | Added amount of wax (% by weight) | $T_{1/2}$ (° C.) | $T_{end}$ (° C.) | Acid value (mgKOH/g) | Volume average particle diameter (μm) | Average circularity |
|---|---|---|---|---|---|---|---|---|
| Ex. 3 | (3) | Paraffin | 3.7 | 118 | 125 | 25.3 | 8.1 | 0.921 |
| Ex. 4 | (4) | Paraffin | 3.9 | 126 | 135 | 22.5 | 8.2 | 0.917 |
| Ex. 5 | (5) | Paraffin | 4.4 | 125 | 133 | 23.2 | 7.9 | 0.920 |
| Ex. 6 | (6) | Polyethylene | 4.5 | 121 | 127 | 22.2 | 7.8 | 0.921 |
| Ex. 7 | (7) | Paraffin | 5.4 | 127 | 135 | 25.1 | 6.5 | 0.954 |
| Ex. 8 | (8) | Paraffin | 5.4 | 120 | 127 | 22.2 | 7.5 | 0.921 |
| Comp. Ex. 1 | (101) | Paraffin | 4.0 | 121 | 128 | 21.5 | 7.6 | 0.921 |
| Comp. Ex. 2 | (102) | Paraffin | 4.0 | 133 | 141 | 20.8 | 7.9 | 0.916 |
| Comp. Ex. 3 | (103) | Paraffin | 4.6 | 118 | 126 | 22.3 | 7.9 | 0.924 |
| Comp. Ex. 4 | (104) | Paraffin | 3.8 | 122 | 128 | 23.7 | 7.8 | 0.925 |
| Comp. Ex. 5 | (105) | Carnauba | 4.5 | 121 | 127 | 22.8 | 7.5 | 0.923 |
| Comp. Ex. 6 | (106) | Paraffin | 12.5 | 132 | 140 | 25.6 | 6.5 | 0.953 |

TABLE 4

| Example | Toner | Separativeness | Fixing strength | Image glossiness | Toner adhesion | Toner filming |
|---|---|---|---|---|---|---|
| Ex. 1 | (1) | Very good | Very good | Very good | Very good | Very good |
| Ex. 2 | (2) | Very good | Very good | Very good | Very good | Very good |
| Ex. 3 | (3) | Good | Very good | Very good | Very good | Very good |
| Ex. 4 | (4) | Very good | Very good | Good | Good | Good |
| Ex. 5 | (5) | Very good | Very good | Good | Very good | Very good |
| Ex. 6 | (6) | Very good | Very good | Very good | Good | Good |
| Ex. 7 | (7) | Very good | Good | Good | Very good | Very good |
| Ex. 8 | (8) | Very good | Very good | Very good | Very good | Good |
| Comp. Ex. 1 | (101) | Very good | Very good | Very good | Poor | Poor |
| Comp. Ex. 2 | (102) | Very good | Poor | Poor | Good | Good |
| Comp. Ex. 3 | (103) | Very good | Good | Very good | Poor | Poor |
| Comp. Ex. 4 | (104) | Poor | Very good | Good | Very good | Very good |
| Comp. Ex. 5 | (105) | Poor | Very good | Very good | Very good | Very good |
| Comp. Ex. 6 | (106) | Very good | Good | Good | Poor | Poor |

Preparation of Resin Composition (H11)

The following components are fed in a dropping funnel.

| | |
|---|---|
| Styrene (vinyl monomer) | 600 parts |
| Butyl acrylate (vinyl monomer) | 110 parts |
| Acrylic acid (vinyl monomer) | 30 parts |
| Dicumyl peroxide (polymerization initiator) | 30 parts |

The following components are fed in a 5-liter four-neck flask equipped with a thermometer, a stainless stirrer, a condenser, and a nitrogen inlet pipe.

| | |
|---|---|
| Polyoxypropylene(2.2)-2,2-bis(4-hydroxyphenyl)propane (polyol) | 1230 parts |
| Polyoxyethylene(2.2)-2,2-bis(4-hydroxyphenyl)propane (polyol) | 290 parts |
| Isododecenyl succinic anhydride (polycarboxylic acid) | 250 parts |
| Terephthalic acid (polycarboxylic acid) | 310 parts |
| 1,2,4-Benzenetricarboxylic acid anhydride (polycarboxylic acid) | 180 parts |

-continued

| | |
|---|---|
| Dibutyl tin oxide (esterification catalyst) | 7 parts |
| Paraffin wax | 340 parts |

(The paraffin wax has a melting point of 73.3° C. and a half bandwidth of 4° C. which is determined from an endothermic peak determined by DSC at a temperature rising scan. The amount of the paraffin wax is 11.0 parts by weight based on 100 parts by weight of the polyester monomers.)

The mixture contained in the four-neck flask is agitated at 160° C. in a mantle heater in nitrogen atmosphere, while the mixture of the vinyl monomers and the polymerization initiator is dropped therein from the dropping funnel over a period of 1 hour. The mixture is further subjected to an addition polymerization reaction for 2 hours at 160° C., and then the mixture is heated to 230° C. so as to be subjected to a condensation polymerization reaction. The polymerization degree of the product is traced by measuring a softening point ($T_{1/2}$) using a constant-pressure extrusion capillary rheometer. The reaction is stopped when the product has a desired softening point.

Thus, a resin composition (H11) is prepared.

Preparations of Resin Compositions (H12) to (H25)

The procedure for preparation of the resin composition (H11) is repeated except that the components are changed so that the resultant resin composition has properties of (H12) to (H25) described in Table 5, respectively.

Thus, resin compositions (H12) to (H25) are prepared.

Preparation of Resin Composition (L11)

The following components are fed in a 5-liter four-neck flask equipped with a thermometer, a stainless stirrer, a condenser, and a nitrogen inlet pipe.

| | |
|---|---|
| Polyoxypropylene(2.2)-2,2-bis(4-hydroxyphenyl)propane (polyol) | 2210 parts |
| Terephthalic acid (polycarboxylic acid) | 850 parts |
| 1,2,4-Benzenetricarboxylic acid anhydride (polycarboxylic acid) | 120 parts |
| Dibutyl tin oxide (esterification catalyst) | 0.5 parts |

The mixture is heated to 230° C. in a mantle heater in nitrogen atmosphere so as to be subjected to a condensation polymerization reaction. The polymerization degree of the product is traced by measuring a softening point ($T_{1/2}$) using a constant-pressure extrusion capillary rheometer. The reaction is stopped when the product has a desired softening point.

Thus, a resin composition (L11) is prepared.

Preparations of Resin Compositions (L12) to (L21)

The procedure for preparation of the resin composition (L11) is repeated expected that the components are changed so that the resultant resin composition has properties of (L12) to (L21) described in Table 5, respectively.

Thus, resin compositions (L12) to (L21) are prepared.

TABLE 5

| Resin composition | $T_{1/2}$ (° C.) | Added amount of wax (parts by weight) |
|---|---|---|
| H11 | 130 | 11 |
| H12 | 121 | 11 |
| H13 | 148 | 11 |
| H14 | 142 | 8 |
| H15 | 124 | 15 |
| H16 | 132 | 12 |
| H17 | 130 | 9 |
| H18 | 132 | 12 |
| H19 | 110 | 15 |
| H20 | 155 | 15 |
| H21 | 130 | 6 |
| H22 | 129 | 17 |
| H23 | 132 | 0 |
| H24 | 130 | 15 |
| H25 | 132 | 8 |
| L11 | 115 | 0 |
| L12 | 100 | 0 |
| L13 | 130 | 0 |
| L14 | 112 | 0 |
| L15 | 120 | 0 |
| L16 | 122 | 0 |
| L17 | 117 | 0 |
| L18 | 95 | 0 |
| L19 | 134 | 0 |
| L20 | 123 | 0 |
| L21 | 109 | 0 |

Examples 9 to 25, Comparative Examples 7 to 13

One hundred (100) parts of each binder resin described in Table 6 and a master batch including 4 parts of a colorant C. I. Pigment Red 57:1 (CARMINE 6B (ECR-102) manufactured by Dainichiseika Color & Chemicals Mfg. Co., Ltd.) are mixed using a HENSCHEL MIXER, respectively. The mixture is melt-kneaded using a double axis extruder (PCM-30 manufactured by Ikegai Co., Ltd.) in which the discharging portion is detached therefrom. The kneaded mixture is rolled with a cooling press roller so that the kneaded mixture has a thickness of 2 mm, and then cooled with a cooling belt. The rolled mixture is coarse-pulverized with a feather mill, and then pulverized with a mechanical pulverizer (KTM manufactured by Kawasaki Heavy Industries, Ltd.). The pulverized particles are subjected to a classification using a jet pulverizer (IDS manufactured by Nippon Pneumatic Mfg. Co., Ltd.) to remove coarse particles, and then subjected to a classification using a rotary classifier (100ATP manufactured by Hosokawa Micron Corporation) to remove fine particles. Thus, mother toner particles are prepared.

Next, 100 parts of the mother toner particles are mixed with a first and a second external additives in an amount described in Table 7 using a HENSCHEL MIXER for 60 seconds at a revolution of 40 m/sec.

Thus, toners (9) to (25) and comparative toners (107) to (113) are prepared.

TABLE 6

| | | Mother toner particle | | | |
|---|---|---|---|---|---|
| | | Binder resins | | | |
| Example | Toner | First resin composition | Second resin composition | Mixing ratio (H/L) | Externally added wax (part) |
| Ex. 9 | (9) | H11 | L11 | 40/60 | — |
| Ex. 10 | (10) | H12 | L11 | 30/70 | — |
| Ex. 11 | (11) | H13 | L11 | 32/68 | — |
| Ex. 12 | (12) | H14 | L11 | 45/55 | — |
| Ex. 13 | (13) | H15 | L11 | 30/70 | — |
| Ex. 14 | (14) | H16 | L12 | 37/63 | — |
| Ex. 15 | (15) | H16 | L13 | 37/63 | — |
| Ex. 16 | (16) | H15 | L11 | 20/80 | — |
| Ex. 17 | (17) | H17 | L11 | 45/55 | — |
| Ex. 18 | (18) | H18 | L11 | 37/63 | — |
| Ex. 19 | (19) | H18 | L11 | 37/63 | — |
| Ex. 20 | (20) | H18 | L11 | 37/63 | — |
| Ex. 21 | (21) | H18 | L11 | 37/63 | — |
| Ex. 22 | (22) | H18 | L11 | 37/63 | — |
| Ex. 23 | (23) | H18 | L11 | 37/63 | — |
| Ex. 24 | (24) | H18 | L11 | 37/63 | — |
| Ex. 25 | (25) | H18 | L11 | 37/63 | — |
| Comp. Ex. 7 | (107) | H19 | L11 | 30/70 | — |
| Comp. Ex. 8 | (108) | H20 | L11 | 30/70 | — |
| Comp. Ex. 9 | (109) | H23 | L16 | 45/55 | 9 |
| Comp. Ex. 10 | (110) | H23 | L17 | 35/65 | 13 |
| Comp. Ex. 11 | (111) | H11 | L18 | 30/70 | — |
| Comp. Ex. 12 | (112) | H11 | L19 | 30/70 | — |
| Comp. Ex. 13 | (113) | H25 | L21 | 50/50 | — |

TABLE 7

| | | External additives | | | | | | |
|---|---|---|---|---|---|---|---|---|
| | | First particulate inorganic material | | | Second particulate inorganic material | | | |
| Example | Toner | Name | BET surface area ($m^2/g$) | Amount (part) | Name | BET surface area ($m^2/g$) | Amount (part) | Total amount (part) |
| Ex. 9 | (9) | RX200 | 180 | 1.2 | NAX50 | 50 | 2.8 | 4 |
| Ex. 10 | (10) | RX200 | 180 | 1.2 | NAX50 | 50 | 2.8 | 4 |
| Ex. 11 | (11) | RX200 | 180 | 1.2 | NAX50 | 50 | 2.8 | 4 |
| Ex. 12 | (12) | RX200 | 180 | 1.2 | NAX50 | 50 | 2.8 | 4 |
| Ex. 13 | (13) | RX200 | 180 | 1.2 | NAX50 | 50 | 2.8 | 4 |
| Ex. 14 | (14) | RX200 | 180 | 1.2 | NAX50 | 50 | 2.8 | 4 |
| Ex. 15 | (15) | RX200 | 180 | 1.2 | NAX50 | 50 | 2.8 | 4 |
| Ex. 16 | (16) | RX200 | 180 | 1.2 | NAX50 | 50 | 2.8 | 4 |
| Ex. 17 | (17) | RX200 | 180 | 1.2 | NAX50 | 50 | 2.8 | 4 |
| Ex. 18 | (18) | H1018 | 100 | 1.2 | NAX50 | 50 | 2.8 | 4 |
| Ex. 19 | (19) | TG811F | 290 | 1.2 | NAX50 | 50 | 2.8 | 4 |
| Ex. 20 | (20) | TS530 | 220 | 1.2 | NAX50 | 50 | 2.8 | 4 |
| Ex. 21 | (21) | TS530 | 220 | 1.2 | H1018 | 100 | 2.8 | 4 |
| Ex. 22 | (22) | RX200 | 180 | 3.0 | NAX50 | 50 | 1.0 | 4 |
| Ex. 23 | (23) | RX200 | 180 | 0.6 | NAX50 | 50 | 3.4 | 4 |
| Ex. 24 | (24) | RX200 | 180 | 1.2 | NAX50 | 50 | 2.8 | 4 |
| Ex. 25 | (25) | RX200 | 180 | 1.2 | NAX50 | 50 | 2.8 | 4 |
| Comp. Ex. 7 | (107) | RX200 | 180 | 1.2 | NAX50 | 50 | 2.8 | 4 |
| Comp. Ex. 8 | (108) | RX200 | 180 | 1.2 | NAX50 | 50 | 2.8 | 4 |
| Comp. Ex. 9 | (109) | RX200 | 180 | 1.2 | NAX50 | 50 | 2.8 | 4 |
| Comp. Ex. 10 | (110) | RX200 | 180 | 1.2 | NAX50 | 50 | 2.8 | 4 |
| Comp. Ex. 11 | (111) | RX200 | 180 | 1.2 | NAX50 | 50 | 2.8 | 4 |
| Comp. Ex. 12 | (112) | RX200 | 180 | 1.2 | NAX50 | 50 | 2.8 | 4 |
| Comp. Ex. 13 | (113) | RX200 | 180 | 1.2 | NAX50 | 50 | 2.8 | 4 |

Evaluations 2

(2-a) Particle Diameter

The volume average particle diameter (Dv) of a toner is measured using an instrument COULETR MULTISIZER II from Coulter Electrons Inc.

The measuring method is as follows:

(1) 2.0 ml of alkylbenzene sulfonate is included as a dispersant in 125 ml of an electrolyte (i.e., 1% aqueous solution of a first grade sodium chloride, such as ISOTON-II from Coulter Electrons Inc.);

(2) 5 mg of a toner is added in the electrolyte, and then the toner is dispersed therein using an ultrasonic dispersing machine for 2 minutes to prepare a toner dispersion liquid;

(3) a volume and a number of the toner particles are measured by the above instrument using an aperture of 100 μm to determine volume and number distribution thereof; and (4) the volume average particle diameter (Dv) is determined.

The measurement channels are the following 13 channels: from 2.00 to less than 2.52 μm; from 2.52 to less than 3.17 μm; from 3.17 to less than 4.00 μm; from 4.00 to less than 5.04 μm; from 5.04 to less than 6.35 μm; from 6.35 to less than 8.00 μm; from 8.00 to less than 10.08 μm; from 10.08 to Less than 12.70 μm; from 12.70 to less than 16.00 μm; from 16.00 to less than 20.20 μm; from 20.20 to less than 25.40 μm; from 25.40 to less than 32.00 μm; and from 32.00 to less than 40.30 μm. Particles having a particle diameter of from not less than 2.00 μm to less than 40.30 μm are measured.

(2-b) $T_{1/2}$ Temperature

The ½ method temperature ($T_{1/2}$) of a resin is determined using SHIMADZU FLOWTESTER CFT-500 (manufactured by Shimadzu Corporation). The flow test is performed under the following conditions.

Sample amount: 1.5 g
Die diameter: 1.0 mm
Die length: 1 mm
Temperature rising speed: 3° C./min
Preheating time: 180 sec
Load: 30 kg
Measurement temperature range: 80 to 140° C.

(2-c) Separativeness

A two-component developer, in which 5 parts of a toner and 95 parts of a silicone-coated carrier are mixed, is set in a modified full-color printer IPSIO CX7500 (manufactured and modified by Ricoh Co., Ltd.) from which the fixing device is detached. The modified full-color printer is adjusted so that a solid image having 1.0 to 1.2 mg/$cm^2$ of the toner thereon is developed on a paper having a cross direction (TYPE 6200 from Ricoh Co., Ltd.) at a position of 3 mm behind the tip thereof while the paper is fed in the vertical direction, and 6 sheets of the paper having an unfixed image thereon are produced.

The fixing device detached from a full-color printer IPSIO CX2500 (manufactured by Ricoh Co., Ltd.) is modified so that the temperature and the linear speed of the fixing belt are variable. Each of the unfixed images prepared above is fixed from the tip portion (i.e., 3 mm-wide margin) thereof using the modified fixing device at a linear speed of 125 mm/sec and a temperature of from 140 to 190° C. in increments of 10° C., respectively. The separativeness is evaluated by the number of sheets in which the unfixed image is normally fixed without occurrence of problems that a paper is wound around the fixing belt, a paper is jammed like an accordion at the exit of the fixing device, etc. The separativeness is graded as follows.

Very good: 6 sheets are normally fixed.

Good: 5 sheets are normally fixed.

Average: 3 to 4 sheets are normally fixed.

Poor: 2 or less sheets are normally fixed.

(2-d) Fixing Strength

A two-component developer, in which 5 parts of a toner and 95 parts of a silicone-coated carrier are mixed, is set in a modified full-color printer IPSIO CX7500 (manufactured and modified by Ricoh Co., Ltd.) from which the fixing device is detached. The modified full-color printer is adjusted so that a solid image having 1.0 to 1.2 mg/cm$^2$ of the toner thereon is developed on a paper having a cross direction (TYPE 6200 from Ricoh Co., Ltd.) at a position of 100 mm behind the tip thereof while the paper is fed in the vertical direction, and the paper having an unfixed image thereon are produced.

The fixing device detached from a full-color printer IPSIO CX2500 (manufactured by Ricoh Co., Ltd.) is modified so that the temperature and the linear speed of the fixing belt are variable. The unfixed image prepared above is fixed using the modified fixing device at a linear speed of 125 mm/sec and a temperature of 140° C. The fixed image is subjected to a drawing test using an automatic drawing tester AD-401 (manufactured by Ueshima Seisakusyo Co., Ltd.), such that a sapphire stylus 125 μR moves on the fixed image at a rotating diameter of 8 mm and a load of 1 g. The image is visually observed to determine the condition of the scratches (i.e., traces) made by the sapphire stylus. The fixing strength is graded as follows.

Very good: Scratches are not recognized.

Good: Scratches are slightly recognized.

Average: Scratches are slightly recognized when the image is observed immediately above, but scratches are not apparently recognized when the image is observed from an angle of 45°.

Poor: Scratches are apparently recognized when the Image is observed immediately above.

(2-e) Image Glossiness

Similarly to the evaluation of the fixing strength, the unfixed image is fixed using the modified fixing device at a linear speed of 125 mm/sec and a temperature of 160° C. The glossiness of the fixed image is measured with a gloss meter (manufactured by Nippon Denshoku Industries Co., Ltd.) at a light entry angle of 60°. Full-color images used in offices preferably have a glossiness of from 5 to 15%.

(2-f) Toner Adhesion

A running test in which 2,000 sheets of a printing pattern having a printing proportion of 6% are continuously produced is performed at 23° C. and 45% RH using a full-color printer CX3000 (manufactured by Ricoh CO., Ltd.). After the running test, the developing roller and the image produced are visually observed and evaluated as follows.

Very good: No striped pattern and patchy unevenness of a toner are observed on the developing roller.

Good: A small amount of striped pattern and patchy unevenness of a toner is observed on the developing roller, but no striped pattern is observed in the image produced. No problem in practical use.

Poor: A large amount of striped pattern and patchy unevenness of a toner is observed on the developing roller, and striped hollow defect is also observed in the image produced. Having a problem in practical use.

(2-g) Toner Filming

After the running test performed in the evaluation of the toner adhesion, the photoreceptor and the Intermediate transfer member are visually observed and evaluated as follows.

Very good: No toner film is observed both on the photoreceptor and the intermediate transfer member.

Good: Toner film is observed either on the photoreceptor or on the intermediate transfer member, but the produced image is normal.

Poor: Toner film is observed either or both of the photoreceptor or on the intermediate transfer member, and the produced image is abnormal.

(2-h) Hollow Defect

Latent images of plural thin line images are written on the photoreceptor of a full-color printer CX3000 (manufactured by Ricoh CO., Ltd.). The latent images are developed with a toner to form toner images. The image forming process is stopped when the toner images are primarily transferred, and then the transfer belt is detached from the printer. Toner images present on the transfer belt are both visually observed and observed with a microscope whether hollow defects are on the thin line images, and evaluated as follows.

Very good: Hollow defect is observed neither on the transfer belt nor in unfixed images.

Good: Some hollow defects are observed in unfixed images, but not observed in fixed images.

Average: Some dot-like hollow defects are observed in fixed images.

Poor: Hollow defects are observed in fixed images.

(2-i) Thermostable Preservability

A toner is preserved for 8 hours at 50° C., and then sieved with a 42-mesh screen for 2 minutes. Thermostable preservability of the toner is evaluated by the residual ratio of the toner remaining on the screen.

The residual ratio is evaluated as follows:

Very good: less than 10%

Good: not less than 10% and less than 20%

Average: not less than 20% and less than 30%

Poor: not less than 30%

The evaluation results are shown in Table 8.

TABLE 8

| Example | Toner | Dv (μm) | Separativeness | Fixing strength | Image glossiness | Toner adhesion | Toner filming | Hollow defect | Thermostable preserveability |
|---|---|---|---|---|---|---|---|---|---|
| Ex. 9 | (9) | 7.2 | Very Good | Very Good | 11.0 | Very Good | Very Good | Very Good | Very Good |
| Ex. 10 | (10) | 7.2 | Very Good | Very Good | 11.1 | Very Good | Very Good | Very Good | Very Good |
| Ex. 11 | (11) | 7.2 | Very Good | Very Good | 6.5 | Very Good | Very Good | Very Good | Very Good |
| Ex. 12 | (12) | 7.2 | Very Good | Very Good | 7.1 | Very Good | Very Good | Very Good | Very Good |
| Ex. 13 | (13) | 7.2 | Very Good | Very Good | 11.4 | Very Good | Very Good | Very Good | Very Good |
| Ex. 14 | (14) | 7.2 | Very Good | Very Good | 10.8 | Very Good | Very Good | Very Good | Very Good |
| Ex. 15 | (15) | 7.2 | Very Good | Very Good | 6.1 | Very Good | Very Good | Very Good | Very Good |
| Ex. 16 | (16) | 7.2 | Very Good | Very Good | 13.5 | Very Good | Very Good | Very Good | Very Good |
| Ex. 17 | (17) | 7.2 | Very Good | Very Good | 6.5 | Very Good | Very Good | Very Good | Very Good |
| Ex. 18 | (18) | 7.2 | Very Good | Very Good | 11.2 | Very Good | Very Good | Very Good | Very Good |
| Ex. 19 | (19) | 7.2 | Very Good | Very Good | 11.7 | Very Good | Very Good | Very Good | Very Good |
| Ex. 20 | (20) | 7.2 | Very Good | Very Good | 12.1 | Very Good | Very Good | Very Good | Very Good |
| Ex. 21 | (21) | 7.2 | Very Good | Very Good | 10.9 | Very Good | Very Good | Very Good | Very Good |
| Ex. 22 | (22) | 7.2 | Very Good | Very Good | 10.8 | Very Good | Very Good | Very Good | Very Good |
| Ex. 23 | (23) | 7.2 | Very Good | Very Good | 11.2 | Very Good | Very Good | Very Good | Very Good |
| Ex. 24 | (24) | 5.1 | Very Good | Very Good | 12.1 | Very Good | Very Good | Very Good | Very Good |
| Ex. 25 | (25) | 9.8 | Very Good | Very Good | 11.0 | Very Good | Very Good | Very Good | Very Good |
| Comp. Ex. 7 | (107) | 7.2 | Poor | Very Good | 12.3 | Good | Good | Very Good | Average |
| Comp. Ex. 8 | (108) | 7.2 | Good | Average | 2.3 | Very Good | Good | Very Good | Very Good |
| Comp. Ex. 9 | (109) | 7.2 | Poor | Poor | 6.7 | Poor | Poor | Very Good | Good |
| Comp. Ex. 10 | (110) | 7.2 | Poor | Poor | 11.2 | Poor | Poor | Very Good | Average |
| Comp. Ex. 11 | (111) | 7.2 | Poor | Very Good | 10.2 | Good | Good | Very Good | Poor |
| Comp. Ex. 12 | (112) | 7.2 | Good | Poor | 2.3 | Very Good | Very Good | Very Good | Very Good |
| Comp. Ex. 13 | (113) | 7.2 | Good | Good | 4.8 | Good | Good | Very Good | Average |

It is clear from Table 8 that the toners (9) to (25) of the present invention have good evaluation results.

The comparative toner (107) has poor separativeness and thermostable preservability because the softening point ($T_{1/2}$) of the first binder resin is too small.

The comparative toner (108) has poor fixing strength and image glossiness because the softening point ($T_{1/2}$) of the first binder resin is too large.

The comparative toners (109) and (110) have poor separativeness, toner filming resistance, and thermostable preservability because the first resin does not internally include a wax.

The comparative toner (111) has poor separativeness and thermostable preservability because the ½ method temperature ($T_{1/2}$) of the second binder resin is too small.

The comparative toner (112) has poor fixing strength and image glossiness because the softening point ($T_{1/2}$) of the second binder resin is too large.

The comparative toner (113) has poor thermostable preservability because the mixing ratio of the first binder resin to the second binder resin is too large.

This document claims priority and contains subject matter related to Japanese Patent Applications Nos. 2005-346392 and 2005-344838, both filed on Nov. 30, 2005, the entire contents of each of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising:

a colorant;

a resin composition (A) comprising at least one binder resin and a hydrocarbon wax having a melting point of 70-90° C. in an amount of from 6 to 30% by weight based on total weight of resin composition (A), and having a softening point ($T_{1/2}$(A)) of from 120 to 150° C.; and a resin composition (B) having a softening point ($T_{1/2}$(B)) of from 100 to 130 C., wherein a weight ratio ((A)/(B)) of the resin composition (A) to the resin composition (B) is from 10/90 to 45/55, and wherein the following relationship is satisfied:

$$T_{1/2}(A) \geqq T_{1/2}(B)+3$$

and wherein the toner has a flow-end temperature ($T_{end}$) of not less than 140° C.

2. The toner according to claim 1, further comprising a hydrocarbon wax other than the hydrocarbon wax present in resin composition (A).

3. The toner according to claim 1, wherein the toner comprises the hydrocarbon wax in an amount of from 3 to 10% by weight.

4. The toner according to claim 1, wherein the toner has a volume average particle diameter of from 4 to 10 μm.

5. The toner according to claim 1, wherein the toner has an acid value of from 10 to 40 mgKOH/g.

6. The toner according to claim 1, wherein the hydrocarbon wax has an endothermic peak having a half bandwidth of not larger than 7° C., wherein the endothermic peak is determined by differential scanning calorimetry.

7. The toner according to claim 1, wherein at least one of the resin composition (A) and the resin composition (B) comprises a polyester skeleton.

8. The toner according to claim 1, further comprising a wax dispersing agent.

9. The toner according to claim 1, wherein the resin composition (A) is prepared by polymerizing at least one monomer in the presence of the hydrocarbon wax.

10. The toner according to claim 9, wherein the monomer comprises a tri- or more functional monomer in an amount of from 0.1 to 5% by weight.

11. The toner according to claim 1, further comprising an external additive in an amount of from 2.5 to 5.0 parts by weight based on the toner, wherein the external additive comprises:

a first particulate inorganic material having a BET specific surface area of from 100 to 300 $m^2/g$; and a second particulate inorganic material having a BET specific surface area of from 40 to 100 $m^2/g$.

12. The toner according to claim 11, wherein the toner has an average circularity of from 0.890 to 0.950.

13. The toner according to claim 1, wherein the toner is prepared by a method comprising:

mixing the colorant, the resin composition (A), and the resin composition (B) with a mixer to prepare a toner constituent mixture;

kneading the toner constituent mixture to prepare a kneaded mixture;

cooling and rolling the kneaded mixture to prepare a rolled mixture;

pulverizing the rolled mixture to prepare a pulverized mixture; and classifying the pulverized mixture.

14. The toner according to claim 1, wherein the toner is prepared by a method comprising:

aggregating particles of the colorant, the resin composition (A), and the resin composition (B) in an aqueous medium.

15. An image forming method, comprising:

forming an electrostatic latent image on an image bearing member;

developing the electrostatic latent image with a toner to form a toner image on the image bearing member;

transferring the toner image onto a recording medium optionally via an intermediate transfer medium; and fixing the toner image on the recording medium, wherein the toner is the toner according to claim 1.

16. An image forming apparatus, comprising:

an image bearing member configured to bear an electrostatic latent image;

a charger configured to charge the image bearing member;

an irradiator configured to irradiate the charged image bearing member with a light beam to form the electrostatic latent image thereon;

a developing device comprising a toner and configured to develop the electrostatic latent image with the toner to form a toner image on the image bearing member;

a transfer device configured to transfer the toner image onto a recording medium; and a fixing device configured to fix the toner image on the recording medium, wherein the toner is the toner according to claim 1, and wherein the fixing device comprises a heating roller and a pressing roller.

17. The image forming apparatus according to claim 16, wherein the fixing device uses no fixing oil.

18. The image forming apparatus according to claim 16, wherein the fixing device comprises a heating device and a belt.

19. A process cartridge, comprising:

an image bearing member configured to bear an electrostatic latent image; and a developing device comprising a toner and configured to develop the electrostatic latent image with the toner to form a toner image, wherein the toner is the toner according to claim 1.

* * * * *